US009695641B2

(12) United States Patent
Schen et al.

(10) Patent No.: US 9,695,641 B2
(45) Date of Patent: Jul. 4, 2017

(54) DRILLING SYSTEMS AND FIXED CUTTER BITS WITH ADJUSTABLE DEPTH-OF-CUT TO CONTROL TORQUE-ON-BIT

(71) Applicant: National Oilwell DHT, L.P., Conroe, TX (US)

(72) Inventors: Aaron E. Schen, Spring, TX (US); Curtis Clifford Lanning, Montgomery, TX (US); Christopher C. Propes, Montgomery, TX (US); Jacob D. Riddel, Humble, TX (US)

(73) Assignee: NATIONAL OILWELL DHT, L.P., Conroe, TX (US)

( * ) Notice: Subject to any disclaimer, the term of this patent is extended or adjusted under 35 U.S.C. 154(b) by 834 days.

(21) Appl. No.: 14/062,006

(22) Filed: Oct. 24, 2013

(65) Prior Publication Data

US 2014/0174827 A1 Jun. 26, 2014

Related U.S. Application Data

(60) Provisional application No. 61/718,492, filed on Oct. 25, 2012.

(51) Int. Cl.

| | |
|---|---|
| ***E21B 10/55*** | (2006.01) |
| ***E21B 10/43*** | (2006.01) |
| ***E21B 10/62*** | (2006.01) |

(52) U.S. Cl.

CPC ..... *E21B 10/55* (2013.01); *E21B 10/43* (2013.01); *E21B 10/62* (2013.01)

(58) Field of Classification Search

CPC ..... E21B 10/43; E21B 10/55; E21B 10/62; E21B 10/64; E21B 10/66; E21B 7/064

See application file for complete search history.

(56) References Cited

U.S. PATENT DOCUMENTS 4,823,892 A 4/1989 Fuller
7,434,634 B1 * 10/2008 Hall ..... E21B 10/62 166/65.1

(Continued)

OTHER PUBLICATIONS

Brochure entitled "Hycalog Hybrid PDC Drill Bits: For Lower Cost Per Foot in Tough Formations" (2 p.).

(Continued)

*Primary Examiner* — Robert E Fuller
*Assistant Examiner* — Christopher Sebesta
(74) *Attorney, Agent, or Firm* — Conley Rose, P.C.

(57) ABSTRACT

A drill bit for drilling a borehole in an earthen formation includes a connection member having a pin end. In addition, the drill bit includes a bit body coupled to the connection member and configured to rotate relative to the connection member about a central axis of the bit. The bit body includes a bit face. Further, the drill bit includes a blade extending radially along the bit face. Still further, the drill bit includes a plurality of cutter elements mounted to a cutter-supporting surface of the blade. Moreover, the drill bit includes a depth-of-cut limiting structure slidably disposed in a bore extending axially from the cutter-supporting surface. The depth-of-cut limiting structure is configured to move axially relative to the bit body in response to rotation of the bit body relative to the connection member.

17 Claims, 17 Drawing Sheets

(56) References Cited

U.S. PATENT DOCUMENTS

| | | | | |
|---|---|---|---|---|
| 2004/0238221 | A1* | 12/2004 | Runia | E21B 7/067 175/61 |
| 2008/0156541 | A1* | 7/2008 | Hall | E21B 4/14 175/296 |
| 2009/0044979 | A1* | 2/2009 | Johnson | E21B 7/06 175/24 |
| 2009/0183919 | A1 | 7/2009 | Hall et al. | |
| 2009/0183920 | A1 | 7/2009 | Hall et al. | |
| 2012/0031677 | A1* | 2/2012 | Schulte | E21B 7/064 175/61 |
| 2014/0027180 | A1* | 1/2014 | Schwefe | E21B 10/43 175/57 |

OTHER PUBLICATIONS

Canadian Office Action dated Feb. 24, 2015; Canadian Application No. 2,831,324 (4 p.).

* cited by examiner

DRILLING SYSTEMS AND FIXED CUTTER BITS WITH ADJUSTABLE DEPTH-OF-CUT TO CONTROL TORQUE-ON-BIT

CROSS-REFERENCE TO RELATED APPLICATIONS

This application claims benefit of U.S. provisional patent application Ser. No. 61/718,492 filed Oct. 25, 2012, and entitled "Drilling Systems and Fixed Cutter Bits with Adjustable Depth-of-Cut to Control Torque-on-Bit," which is hereby incorporated herein by reference in its entirety.

STATEMENT REGARDING FEDERALLY SPONSORED RESEARCH OR DEVELOPMENT

Not applicable.

BACKGROUND

The present invention relates generally to drilling systems and earth-boring drill bits for drilling a borehole for the ultimate recovery of oil, gas, or minerals. More particularly, the invention relates to fixed cutter bits having an adjustable depth-of-cut to dynamically control the torque-on-bit.

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole thus created will have a diameter generally equal to the diameter or "gage" of the drill bit.

Fixed cutter bits, also known as rotary drag bits, are one type of drill bit commonly used to drill wellbores. Fixed cutter bit designs include a plurality of blades angularly spaced about the bit face. The blades generally project radially outward along the bit body and form flow channels there between. In addition, cutter elements are often grouped and mounted on several blades. The configuration or layout of the cutter elements on the blades may vary widely, depending on a number of factors. One of these factors is the formation itself, as different cutter element layouts engage and cut the various strata with differing results and effectiveness.

The cutter elements disposed on the several blades of a fixed cutter bit are typically formed of extremely hard materials and include a layer of polycrystalline diamond ("PD") material. In the typical fixed cutter bit, each cutter element or assembly comprises an elongate and generally cylindrical support member which is received and secured in a pocket formed in the surface of one of the several blades. In addition, each cutter element typically has a hard cutting layer of polycrystalline diamond or other superabrasive material such as cubic boron nitride, thermally stable diamond, polycrystalline cubic boron nitride, or ultrahard tungsten carbide (meaning a tungsten carbide material having a wear-resistance that is greater than the wear-resistance of the material forming the substrate) as well as mixtures or combinations of these materials. The cutting layer is exposed on one end of its support member, which is typically formed of tungsten carbide. For convenience, as used herein, reference to "PDC bit" or "PDC cutter element" refers to a fixed cutter bit or cutting element employing a hard cutting layer of polycrystalline diamond or other superabrasive material such as cubic boron nitride, thermally stable diamond, polycrystalline cubic boron nitride, or ultrahard tungsten carbide.

While the bit is rotated, drilling fluid is pumped through the drill string and directed out of the face of the drill bit. The fixed cutter bit typically includes nozzles or fixed ports spaced about the bit face that serve to inject drilling fluid into the flow passageways between the several blades. The flowing fluid performs several important functions. The fluid removes formation cuttings from the bit's cutting structure. Otherwise, accumulation of formation materials on the cutting structure may reduce or prevent the penetration of the cutting structure into the formation. In addition, the fluid removes cut formation materials from the bottom of the hole. Failure to remove formation materials from the bottom of the hole may result in subsequent passes by cutting structure to re-cut the same materials, thereby reducing the effective cutting rate and potentially increasing wear on the cutting surfaces. The drilling fluid and cuttings removed from the bit face and from the bottom of the hole are forced from the bottom of the borehole to the surface through the annulus that exists between the drill string and the borehole sidewall. Further, the fluid removes heat, caused by contact with the formation, from the cutter elements in order to prolong cutter element life. Thus, the number and placement of drilling fluid nozzles, and the resulting flow of drilling fluid, may significantly impact the performance of the drill bit.

Without regard to the type of bit, the cost of drilling a borehole for recovery of hydrocarbons may be very high, and is proportional to the length of time it takes to drill to the desired depth and location. The time required to drill the well, in turn, is greatly affected by the number of times the drill bit must be changed before reaching the targeted formation. This is the case because each time the bit is changed, the entire string of drill pipe, which may be miles long, must be retrieved from the borehole, section by section. Once the drill string has been retrieved and the new bit installed, the bit must be lowered to the bottom of the borehole on the drill string, which again must be constructed section by section. As is thus obvious, this process, known as a "trip" of the drill string, requires considerable time, effort and expense. Accordingly, it is desirable to employ drill bits which will drill faster and longer, and which are usable over a wider range of formation hardness. The length of time that a drill bit may be employed before it must be changed depends upon a variety of factors. These factors include the bit's rate of penetration ("ROP"), as well as its durability or ability to maintain a high or acceptable ROP.

Control over the torque-on-bit (TOB) can improve bit durability by reducing the potential for stick slip, torsional vibrations, and torque oscillations, each of which can damage PDC cutters. One conventional means for controlling TOB is to limit the maximum depth-of-cut (DOC) of the cutter elements on the bit with one or more passive/static DOC limiting structures. One example of a static DOC limiting structures are dome-shaped inserts mounted to the bit blades preceding or trailing one or more cutter elements. The cutter elements engage the formation before the dome-shaped inserts. However, when a predetermined DOC is achieved, the dome-shaped inserts come into engagement with and bear against the formation, thereby restricting the cutter elements from cutting deeper into the formation and defining a maximum DOC.

A significant amount of time and effort is spent determining where to position conventional passive/static DOC limiting structures for TOB management at given rates of penetration (ROP) and weights-on-bit (WOB). Often the determination is an educated guess based on offset data, design experience and computer analyses, and often produces less than ideal results across a variety of parameters and formations. Further, such passive/static DOC limiting structures function as on/off torque control features as they limit TOB only when bearing against the formation.

BRIEF SUMMARY OF THE DISCLOSURE

These and other needs in the art are addressed in one embodiment by a drill bit for drilling a borehole in an earthen formation. The bit has a central axis and a cutting direction of rotation. In an embodiment, the drill bit comprises a connection member having a pin end. In addition, the drill bit comprises a bit body coupled to the connection member and configured to rotate relative to the connection member about the axis. The bit body includes a bit face. Further, the drill bit comprises a blade extending radially along the bit face. Still further, the drill bit comprises a plurality of cutter elements mounted to a cutter-supporting surface of the blade. Moreover, the drill bit comprises a depth-of-cut limiting structure slidably disposed in a bore extending axially from the cutter-supporting surface. The depth-of-cut limiting structure is configured to move axially relative to the bit body in response to rotation of the bit body relative to the connection member.

These and other needs in the art are addressed in another embodiment by a method for managing torque-on-bit while drilling a borehole in an earthen formation. In an embodiment, the method comprises (a) engaging the formation with a fixed cutter bit. In addition, the method comprises (b) applying weight-on-bit. Further, the method comprises (c) applying a first torque-on-bit to rotate the fixed cutter bit about a central axis. Still further, the method comprises (d) increasing the torque-on-bit from the first torque-on-bit to a second torque-on-bit that is greater than the first torque-on-bit. Moreover, the method comprises (e) extending a depth-of-cut control structure axially from the bit face in response to the increase in the torque-on-bit.

These and other needs in the art are addressed in another embodiment by a drill bit for drilling a borehole in an earthen formation. The bit has a central axis and a cutting direction of rotation. In an embodiment, the drill bit comprises a connection member having a first end and a second end opposite the first end. The first end comprises a pin end and the second end comprises a rolling cone bit. In addition, the drill bit comprises a fixed cutter bit coupled to the connection member and configured to rotate relative to the connection member about the axis and move axially relative to the connection member. The fixed cutter bit has a bit face. Further, the drill bit comprises a biasing member axially disposed between the fixed cutter bit and the pin end. The biasing member is configured to resist the rotation of the fixed cutter bit relative to the connection member.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF SOME OF THE PREFERRED EMBODIMENTS

Figure 1:
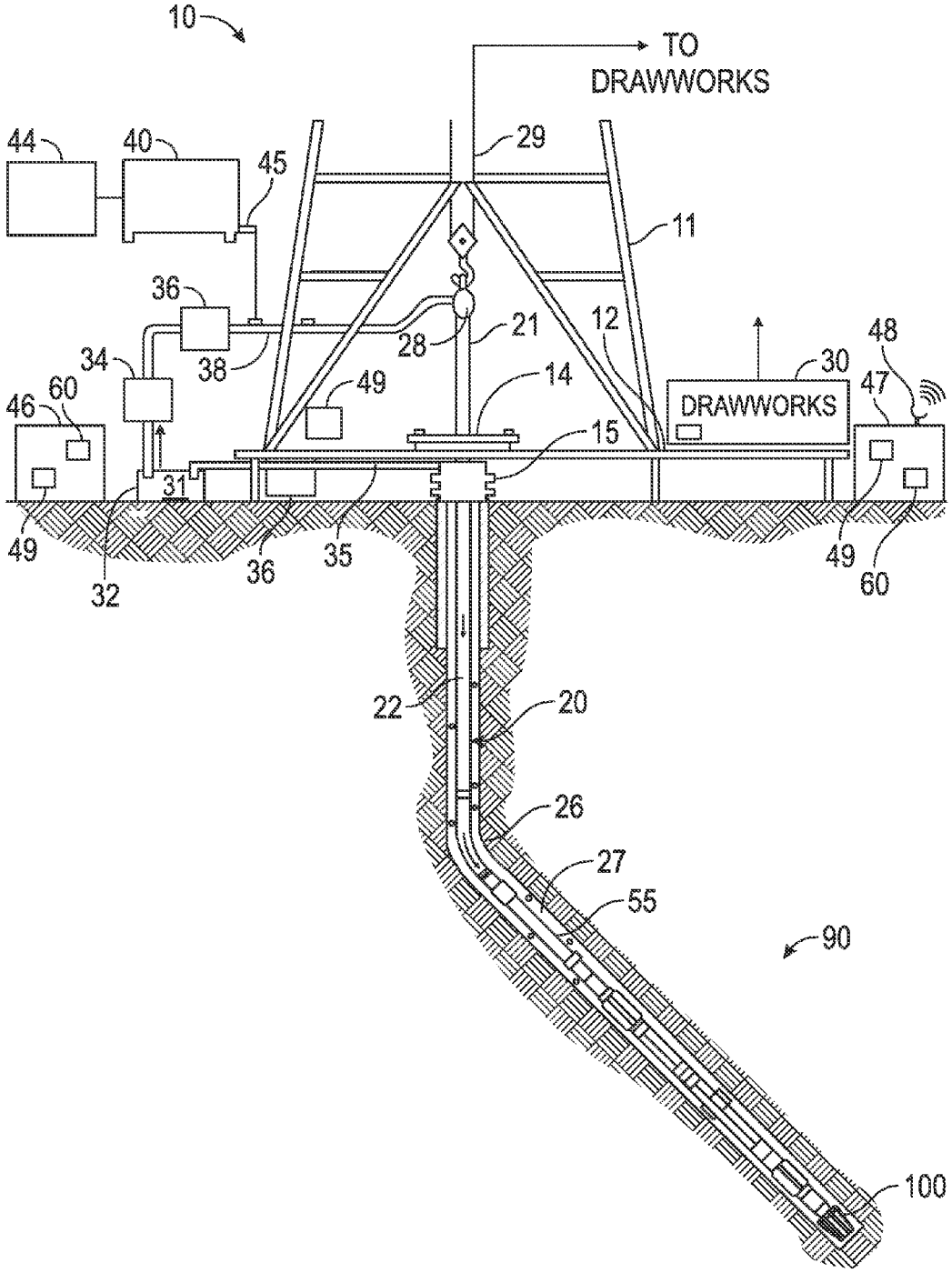
FIG. 1 is a schematic view of a drilling system including an embodiment of a drill bit in accordance with the principles described herein.

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Referring now to FIG. 1, a schematic view of an embodiment of a drilling system 10 in accordance with the principles described herein is shown. Drilling system 10 includes a derrick 11 having a floor 12 supporting a rotary table 14 and a drilling assembly 90 for drilling a borehole 26 from derrick 11. Rotary table 14 is rotated by a prime mover such as an electric motor (not shown) at a desired rotational speed and controlled by a motor controller (not shown). The motor controller may be a silicon controlled rectifier (SCR) system, a Variable Frequency Device (VFD), or other type of suitable controller. In other embodiments, the rotary table (e.g., rotary table 14) may be augmented or replaced by a top drive suspended in the derrick (e.g., derrick 11) and connected to the drillstring (e.g., drillstring 20).

Drilling assembly 90 includes a drillstring 20 and a drill bit 100 coupled to the lower end of drillstring 20. Drillstring 20 is made of a plurality of pipe joints 22 connected end-to-end, and extends downward from the rotary table 14 through a pressure control device 15 into the borehole 26. The pressure control device 15 is commonly hydraulically powered and may contain sensors for detecting certain operating parameters and controlling the actuation of the pressure control device 15. Drill bit 100 is rotated with weight-on-bit (WOB) applied to drill the borehole 26 through the earthen formation. Drillstring 20 is coupled to a drawworks 30 via a kelly joint 21, swivel 28, and line 29 through a pulley. During drilling operations, drawworks 30 is operated to control the WOB, which impacts the rate-of-penetration of drill bit 100 through the formation. In this embodiment, drill bit 100 can be rotated from the surface by drillstring 20 via rotary table 14 and/or a top drive, rotated by downhole mud motor 55 disposed along drillstring 20 proximal bit 100, or combinations thereof (e.g., rotated by both rotary table 14 via drillstring 20 and mud motor 55, rotated by a top drive and the mud motor 55, etc.). For example, rotation via downhole motor 55 may be employed to supplement the rotational power of rotary table 14, if required, and/or to effect changes in the drilling process. In either case, the rate-of-penetration (ROP) of the drill bit 100 into the borehole 26 for a given formation and a drilling assembly largely depends upon the WOB and the rotational speed of bit 100.

During drilling operations a suitable drilling fluid 31 is pumped under pressure from a mud tank 32 through the drillstring 20 by a mud pump 34. Drilling fluid 31 passes from the mud pump 34 into the drillstring 20 via a desurger 36, fluid line 38, and the kelly joint 21. The drilling fluid 31 pumped down drillstring 20 flows through mud motor 55 and is discharged at the borehole bottom through nozzles in face of drill bit 100, circulates to the surface through an annular space 27 radially positioned between drillstring 20 and the sidewall of borehole 26, and then returns to mud tank 32 via a solids control system 36 and a return line 35. Solids control system 36 may include any suitable solids control equipment known in the art including, without limitation, shale shakers, centrifuges, and automated chemical additive systems. Control system 36 may include sensors and automated controls for monitoring and controlling, respectively, various operating parameters such as centrifuge rpm. It should be appreciated that much of the surface equipment for handling the drilling fluid is application specific and may vary on a case-by-case basis.

Figure 2:
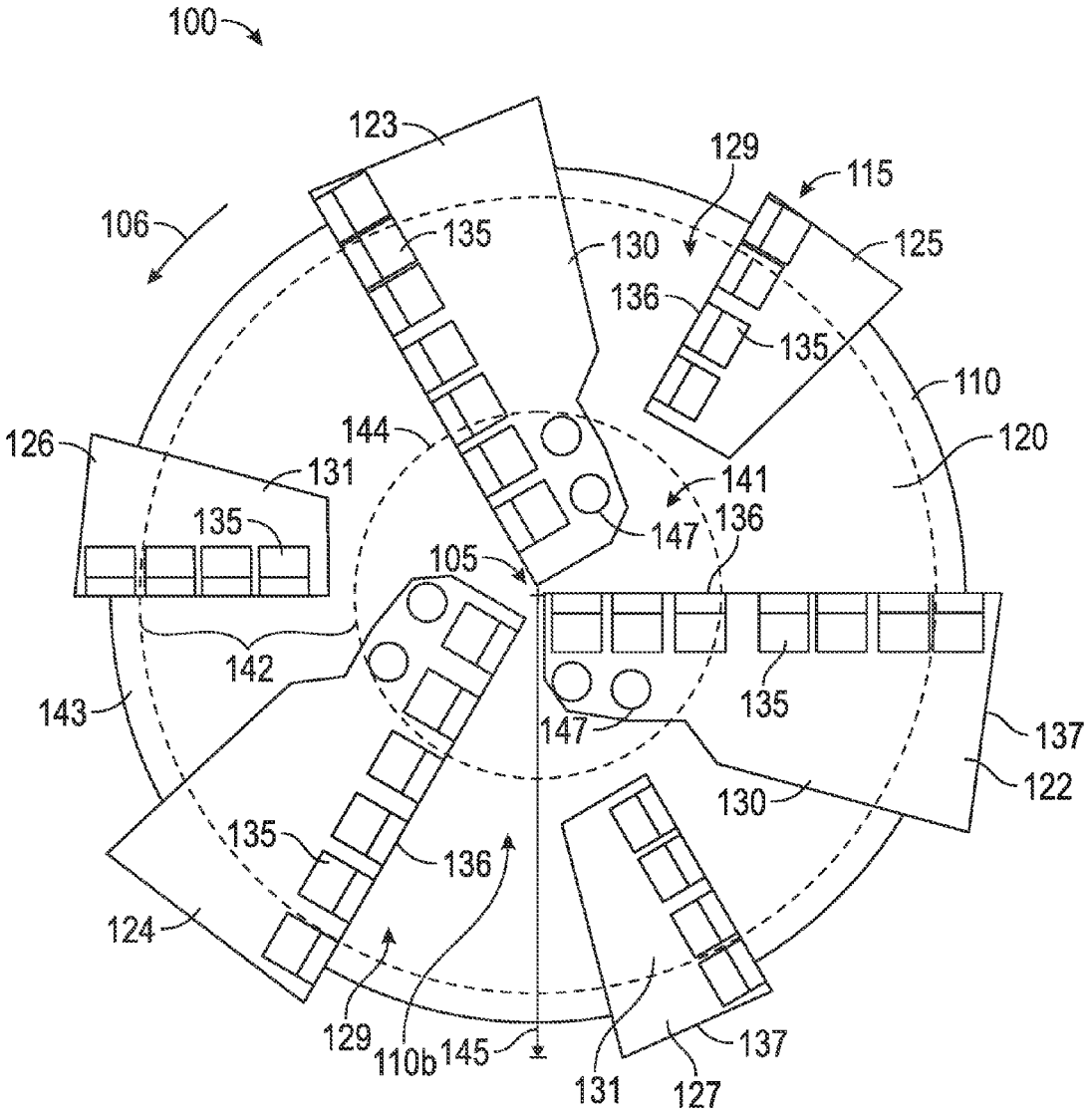
FIG. 2 is a schematic end view of the drill bit shown in FIG. 1.
Figure 3:
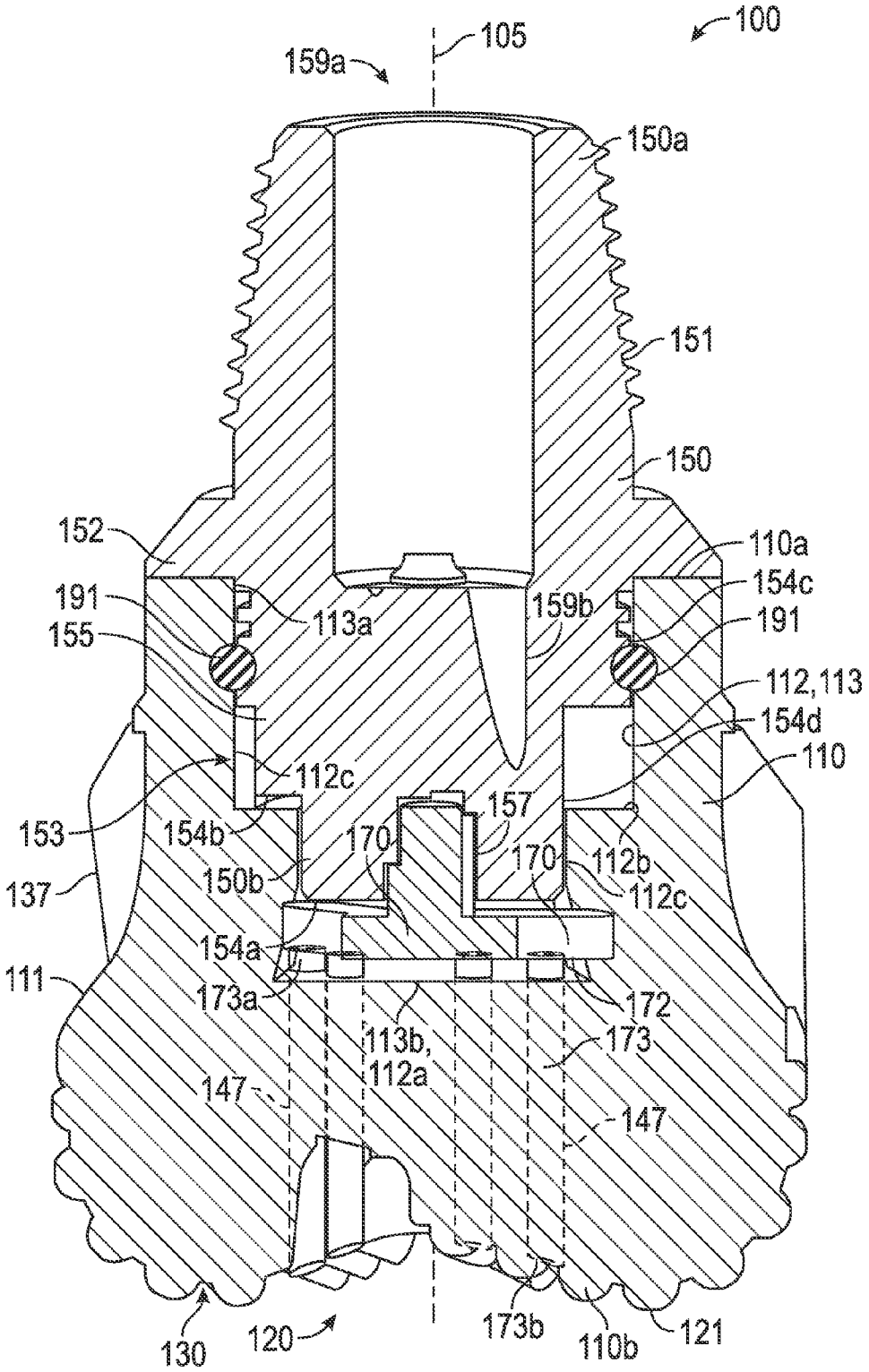
FIG. 3 is a cross-sectional view of the drill bit of FIG. 2.

Referring now to FIGS. 2 and 3, drill bit 100 is a fixed cutter bit, sometimes referred to as a drag bit, and is preferably a PDC bit adapted for drilling through formations of rock to form a borehole. In this embodiment, bit 100 includes a bit body 110, a connection member 150 rotatably coupled to bit body 110, and a torque control member 170 moveably coupled to body 110 and connection member 150. Bit 100 has a central or longitudinal axis 105 about which bit 100 rotates in the cutting direction represented by arrow 106. Bit body 110, connection member 150, and torque control member 170 are each coaxially aligned with axis 105. Thus, bit body 110, connection member 150, and torque control member 170 each have a central axis coincident with axis 105.

Figure 5:
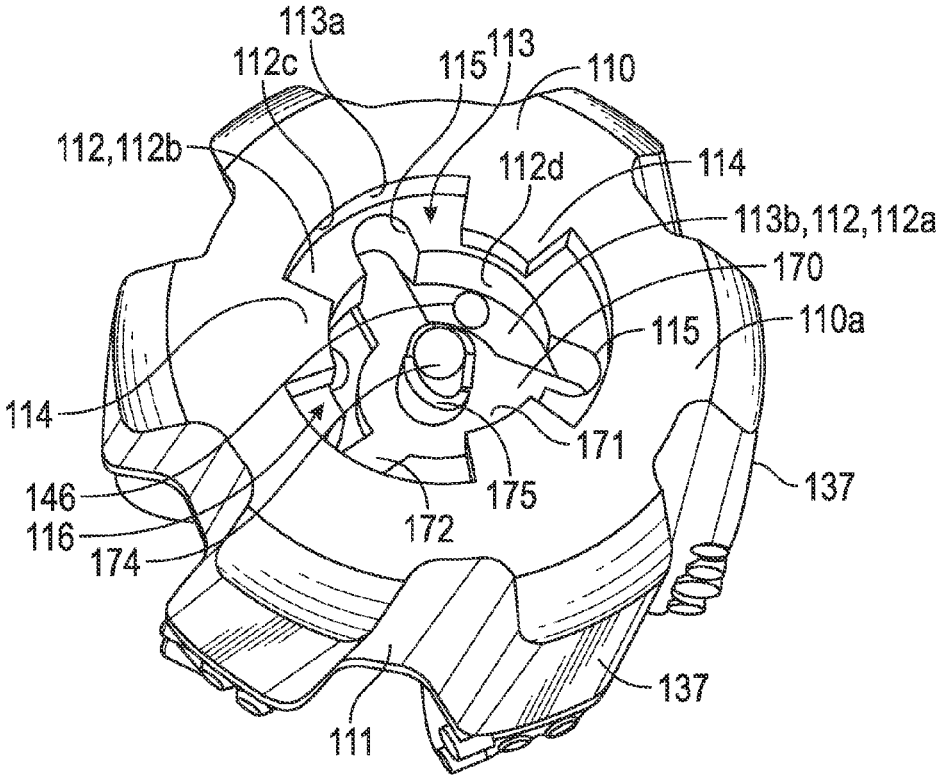
FIG. 5 is a perspective view of the torque control member seated in the bit body of the drill bit of FIG. 3.

Referring now to FIGS. 3 and 5, bit body 110 has a first or upper end 110*a*, a second or lower end 110*b* opposite end 110*a*, an outer surface 111 extending between ends 110*a*, 110*b*, and an inner surface 112 defined by a generally cylindrical cavity or receptacle 113 extending axially from upper end 110*a* and centered about axis 105 (i.e., coaxially aligned with axis 105). Thus, receptacle 113 may be described as having a first or upper end 113*a* coincident with end 110*a* and a second or lower end 113*b* disposed within bit body 110 opposite end 113*a*.

As best shown in FIG. 5, inner surface 112 includes a planar surface 112*a* defining the lower end 113*b* of receptacle 113, a planar generally annular shoulder 112*b* axially positioned between end 110*a* and surface 112*a*, a generally cylindrical surface 112*c* extending axially from end 110*a* to shoulder 112*b*, and a generally cylindrical surface 112*d* extending axially from shoulder 112*b* to surface 112*a*. Surfaces 112*a*, 112*b* are parallel, and each lies in a plane oriented perpendicular to axis 105. In addition, cylindrical surface 112*d* is disposed at a radius that is less than the radius at which surface 112*c* is disposed.

Inner surface 112 also includes a plurality of uniformly circumferentially-spaced lugs or splines 114 extending radially inward from cylindrical surface 112*c* and a plurality of uniformly circumferentially-spaced recesses 115 extending radially outward from cylindrical surface 112*d*. Splines 114 define circumferentially-spaced recesses 116—one recess 116 extends circumferentially between each pair of splines 114. In this embodiment, three splines 114 circumferentially-spaced 120° apart are provided, and three recesses 115 circumferentially-spaced 120° apart are provided. Further, in this embodiment, one recess 115 is circumferentially centered between each pair of circumferentially adjacent splines 114. Each spline 114 extends axially from end 110*a* to shoulder 112*b* and has the same size and geometry, and each recess 115 extends axially from shoulder 112*b* to surface 112*a* and has the same size and geometry.

Body 110 may be formed in a conventional manner using powdered metal tungsten carbide particles in a binder material to form a hard metal cast matrix. Alternatively, the body can be machined from a metal block, such as steel, rather than being formed from a matrix.

Referring now to FIGS. 2 and 3, lower end 110*b* of bit body 110 that faces the formation includes a bit face 120 provided with a cutting structure 121. Cutting structure 121 includes a plurality of blades which extend from bit face 120. In the embodiment illustrated in FIGS. 2 and 3, cutting structure 121 includes three angularly spaced-apart primary blades 122, 123, 124, and three angularly spaced apart secondary blades 125, 126, 127. Further, in this embodiment, the plurality of blades (e.g., primary blades 122, 123, 124 and secondary blades 125, 126, 127) are uniformly angularly spaced on bit face 120 about bit axis 105. In particular, the three primary blades 122, 123, 124 are uniformly angularly spaced about 120° apart, and the three secondary blades 125, 126, 127 are uniformly angularly spaced about 120° apart, and each primary blade 122, 123, 124 is angularly spaced about 60° from each circumferentially adjacent secondary blade 125, 126, 127. In other embodiments, one or more of the blades may be spaced non-uniformly about bit face 120. Still further, primary blades 122, 123, 124 and secondary blades 125, 126, 127 are circumferentially arranged in an alternating fashion. In other words, one secondary blade 125, 126, 127 is disposed between each pair of primary blades 122, 123, 124. Although bit 100 is shown as having three primary blades 122, 123, 124 and three secondary blades 125, 126, 127, in general, bit 100 may comprise any suitable number of primary and secondary blades. As one example only, bit 100 may comprise two primary blades and four secondary blades.

In this embodiment, primary blades 122, 123, 124 and secondary blades 125, 126, 127 are integrally formed as part of, and extend from, bit body 110 and bit face 120. Primary blades 122, 123, 124 and secondary blades 125, 126, 127 extend generally radially along bit face 120 and then axially along a portion of the periphery of bit 100. In particular, primary blades 122, 123, 124 extend radially from proximal central axis 105 toward the periphery of bit body 110. Primary blades 122, 123, 124 and secondary blades 125, 126, 127 are separated by drilling fluid flow courses 129.

Referring still to FIGS. 2 and 3, each primary blade 122, 123, 124 includes a cutter-supporting surface 130 for mounting a plurality of cutter elements 135, and each secondary blade 125, 126, 127 includes a cutter-supporting surface 131 for mounting a plurality of cutter elements 135. In particular, cutter elements 135 are arranged adjacent one another in a radially extending row proximal the leading edge of each primary blade 122, 123, 124 and each secondary blade 125, 126, 127. Each cutter element 135 has a cutting face 136 and comprises an elongated and generally cylindrical support member or substrate which is received and secured in a pocket formed in the surface of the blade to which it is fixed. In general, each cutter element may have any suitable size and geometry. In this embodiment, each cutter element 135 has substantially the same size and geometry. Cutting face 136 of each cutter element 135 comprises a disk or tablet-shaped, hard cutting layer of polycrystalline diamond or other superabrasive material is bonded to the exposed end of the support member. In the embodiments described herein, each cutter element 135 is mounted such that its cutting face 136 is generally forward-facing. As used herein, "forward-facing" is used to describe the orientation of a surface that is substantially perpendicular to, or at an acute angle relative to, the cutting direction of the bit (e.g., cutting direction 106 of bit 100). For instance, a forward-facing cutting face (e.g., cutting face 136) may be oriented perpendicular to the cutting direction of bit 100, may include a backrake angle, and/or may include a siderake angle. However, the cutting faces are preferably oriented perpendicular to the direction of rotation of bit 100 plus or minus a 45° backrake angle and plus or minus a 45° siderake angle. In addition, each cutting face 136 includes a cutting edge adapted to positively engage, penetrate, and remove formation material with a shearing action, as opposed to the grinding action utilized by impregnated bits to remove formation material. Such cutting edge may be chamfered or beveled as desired. In this embodiment, cutting faces 136 are substantially planar, but may be convex or concave in other embodiments.

Referring still to FIGS. 2 and 3, bit body 110 further includes gage pads 137 of substantially equal axial length measured generally parallel to bit axis 105. Gage pads 137 are circumferentially-spaced about outer surface 111 of bit body 110. Specifically, gage pads 137 intersect and extend from each blade 122-127. In this embodiment, gage pads 137 are integrally formed as part of the bit body 110. In general, gage pads 137 can help maintain the size of the borehole by a rubbing action when cutter elements 135 wear slightly under gage. Gage pads 137 also help stabilize bit 100 against vibration.

Figure 4:
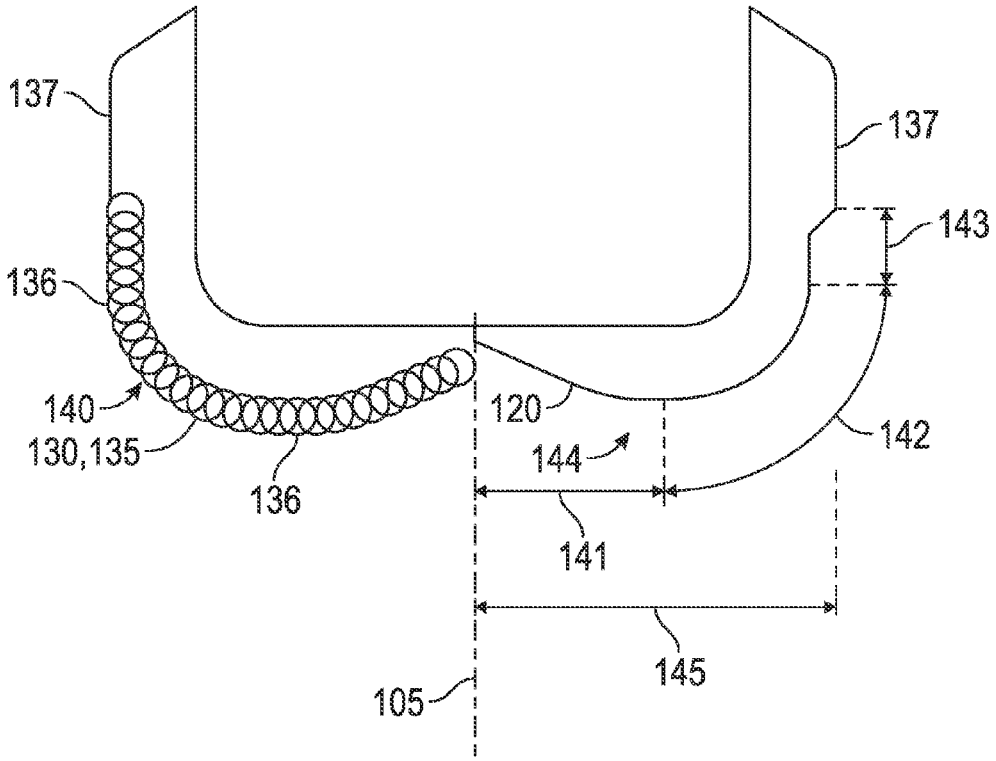
FIG. 4 is a partial cross-sectional view of the bit shown in FIG. 2 with the blades and the cutting faces of the cutter elements rotated into a single composite profile.

Referring now to FIG. 4, an exemplary profile of bit body 110 is shown as it would appear with blades 122-127 and cutter elements 135 rotated into a single rotated profile. In rotated profile view, blades 122-127 of bit body 110 form a combined or composite blade profile 140 generally defined by cutter-supporting surfaces 130 of blades 122-127. Composite blade profile 140 and bit face 120 may generally be divided into three regions conventionally labeled cone region 141, shoulder region 142, and gage region 143. Cone region 141 comprises the radially innermost region of bit body 110 and composite blade profile 140 extending from bit axis 105 to shoulder region 142. In this embodiment, cone region 141 is generally concave. Adjacent cone region 141 is generally convex shoulder region 142. The transition between cone region 141 and shoulder region 142, typically referred to as the nose or nose region 144, occurs at the axially outermost portion of composite blade profile 140 where a tangent line to the blade profile 140 has a slope of zero. Moving radially outward, adjacent shoulder region 142 is the gage region 143 which extends substantially parallel to bit axis 105 at the outer radial periphery of composite blade profile 140. In this embodiment, gage pads 137 extend from each blade 122-127 as previously described. As shown in composite blade profile 140, gage pads 137 define the outer radius 145 of bit body 110. Outer radius 145 extends to and therefore defines the full gage diameter of bit body 110. As used herein, the term "full gage diameter" refers to elements or surfaces extending to the full, nominal gage of the bit diameter.

Referring briefly to FIG. 2, moving radially outward from bit axis 105, bit face 120 includes cone region 141, shoulder region 142, and gage region 143 as previously described.

Primary blades 122, 123, 124 extend radially along bit face 120 from within cone region 141 proximal bit axis 105 toward gage region 143 and outer radius 145. Secondary blades 125, 126, 127 extend radially along bit face 120 from proximal nose region 144 toward gage region 143 and outer radius 145. In this embodiment, secondary blades 125, 126, 127 do not extend into cone region 141, and thus, secondary blades 125, 126, 127 occupy no space on bit face 120 within cone region 141. In other embodiments, the secondary blades (e.g., secondary blades 125, 126, 127) may extend to and/or slightly into the cone region (e.g., cone region 141). In this embodiment, each primary blade 122, 123, 124 and each secondary blade 125, 126, 127 extends substantially to gage region 143 and outer radius 145. However, in other embodiments, one or more primary and/or secondary blades may not extend completely to the gage region or outer radius of the bit.

Although a specific embodiment of bit body 110 has been shown in described, one skilled in the art will appreciate that numerous variations in the size, orientation, and locations of the blades (e.g., primary blades 122, 123, 124, secondary blades, 125, 126, 127, etc.), and cutter elements (e.g., cutter elements 135) are possible.

As best seen in FIG. 5, body 110 includes a plurality of circumferentially-spaced flow passages 146 extending from surface 112*a* and receptacle 113 to bit face 120. Passages 146 have ports or nozzles disposed at their lowermost ends (at lower end 110*b* of bit body 110), and permit drilling fluid from drillstring 20 to flow through bit body 110 around a cutting structure 121 to flush away formation cuttings during drilling and to remove heat from bit body 110. In addition, as shown in FIG. 3, bit body 110 includes a plurality of bores 147 extending axially from surface 112*a* and receptacle 113 to cutter-supporting surfaces 130 of primary blades 122, 123, 124 in cone region 141. In this embodiment, bores 147 are arranged in three circumferentially-spaced pairs, with the two bores 147 in each pair being radially spaced apart. Thus, two radially spaced bores 147 extend through bit body 110 from receptacle 113 to cutter-supporting surface 130 of each primary blade 122, 123, 124 in cone region 141. Each bore 147 is oriented parallel to axis 105, and further, each bore 147 trails (relative to the direction of rotation 106 of bit 100) the cutter elements 135 on the same primary blade 122, 123, 124. Although each bore 147 extends to cutter-supporting surface 130 of one primary blade 122, 123, 124 in this embodiment, in other embodiments, one or more of the bores (e.g., bores 147) can be disposed between primary blades (e.g., blades 122, 123, 124). Still further, at bit face 120, any two or more bores 147 can have the same or different radial positions.

Figure 6:
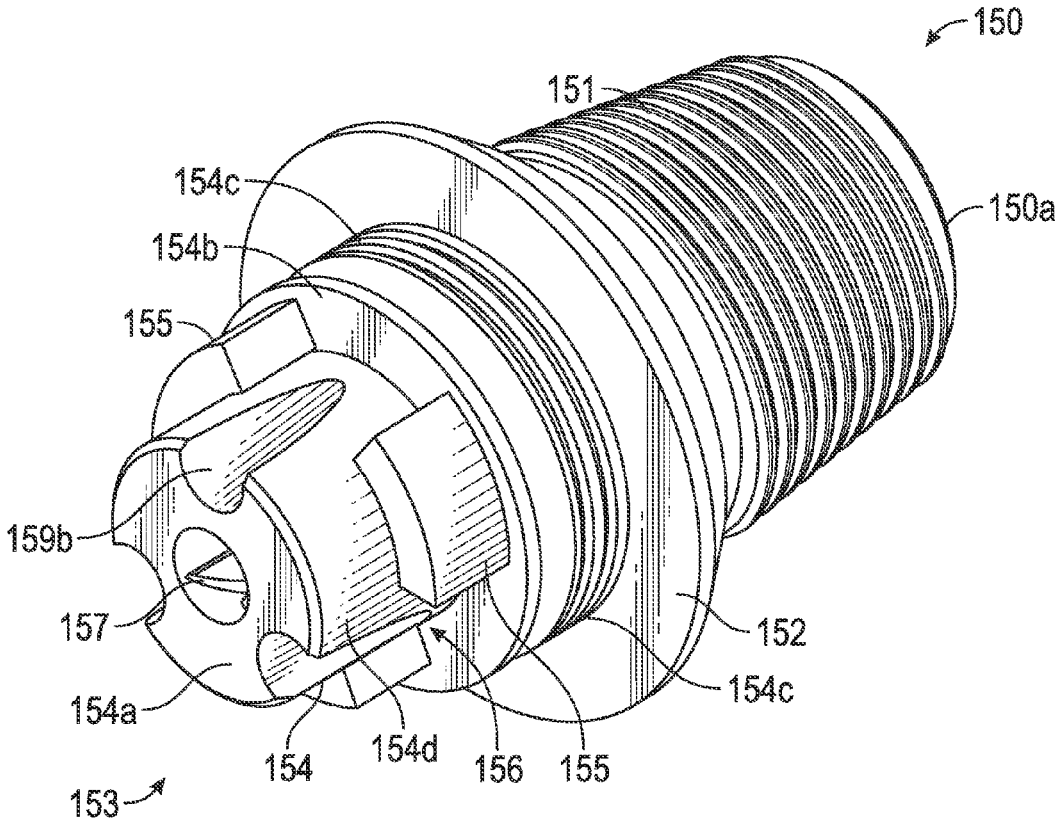
FIG. 6 is a perspective view of the connection member of the drill bit of FIG. 3.

Referring now to FIGS. 3 and 6, connection member 150 includes a first or upper end 150*a*, a second or lower end 150*b* opposite end 150*b*, an externally threaded pin end 151 extending axially from upper end 150*a* to an annular flange 152, and a male insert portion 153 extending axially from lower end 150*b* to flange 152. As best shown in FIG. 3, upon assembly of bit 100, insert portion 153 is seated in receptacle 113 of bit body 110, flange 152 axially abuts upper end 110*a* of bit body 110, and pin end 151 extends axially upward from bit body 110. Pin end 151 is adapted for securing the bit 100 to drillstring 20.

Male insert portion 153 is generally sized and configured to mate with the contours of receptacle 113 and inner surface 112 of bit body 110. In particular, insert portion 153 has an outer surface 154 including a planar surface 154*a* defining lower end 150*b*, a planar annular shoulder 154*b* axially positioned between flange 152 and surface 154*a*, a cylindrical surface 154*c* extending axially from flange 152 to shoulder 154*b*, and a cylindrical surface 154*d* extending axially from shoulder 154*b* to surface 154*a*. Surfaces 154*a*, 154*b* are parallel, and each lies in a plane oriented perpendicular to axis 105. In addition, cylindrical surface 154*d* is disposed at a radius that is less than the radius of cylindrical surface 154*c*.

Outer surface 154 also includes a plurality of uniformly circumferentially-spaced lugs or splines 155 extending radially outward from cylindrical surface 154*d*. Splines 155 define circumferentially-spaced recesses 156—one recess 156 extends circumferentially between each pair of splines 155. In this embodiment, three splines 155 circumferentially-spaced 120° apart are provided. Each spline 155 extends axially from shoulder 154*b*, but does not extend to end 150*b*. Further, each spline 155 has the same size and geometry.

As best shown in FIG. 6, a generally cylindrical counterbore or receptacle 157 extends axially from end 150*b* and surface 154*a* into insert portion 153. Receptacle 157 is coaxially aligned with axis 105. In this embodiment, the surface defining receptacle 157 includes a plurality of circumferentially spaced helical shoulders or ramps 158, each ramp 158 extending helically about axis 105 from end 150*b*.

Figure 7:
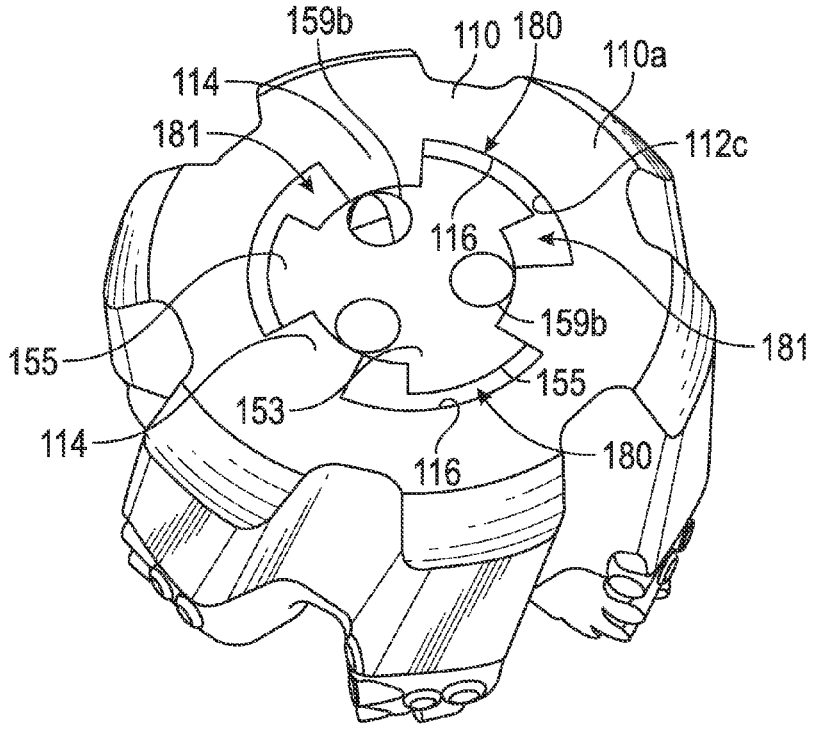
FIG. 7 is a perspective cross-sectional view taken along section 7-7 of FIG. 3.

Referring now to FIGS. 3, 6, and 7, connection member 150 includes a counterbore 159*a* extending axially from end 150*a* through pin end 151 and a plurality of a flow passages 159*b* extending from counterbore 159*a* through insert portion 153 to end 150*b*. In this embodiment, passages 159*b* intersect surfaces 154*a*, 154*d*. Upon assembly of bit 100, counterbore 159*a* and passages 159*b* are in fluid communication with passages 146 of bit body 110, thereby permitting drilling fluid to flow from drillstring 20 through connection member 150 and bit body 110 to cutting structure 121.

Referring now to FIGS. 3, 5, 6, and 8, torque control member 170 includes a base 171, a plurality of circumferentially-spaced arms 172 extending radially outward from base 171, a plurality of radially-spaced elongate cylindrical extension rods 173 extending axially from each arm 172, and an actuation member 174 extending axially from base 171. Rods 173 and actuation member 174 are parallel to axis 105, however, rods 173 are radially spaced from axis 105 whereas actuation member 174 is coaxially aligned with axis 105. In this embodiment, three arms 172, spaced 120° apart, are provided, and two extension rods 173 extend from each arm 172. It should be appreciated that actuation member 174 extends axially from base 171, and rods 173 extend axially in the opposite direction from arms 172. Actuation member 174 is generally cylindrical and includes a plurality of circumferentially-spaced helical shoulders or ramps 175 sized and configured to mate and slidingly engage helical ramps 158 of connection member 150. In particular, each ramp 175 is positioned to engage one mating ramp 158.

Figure 8:
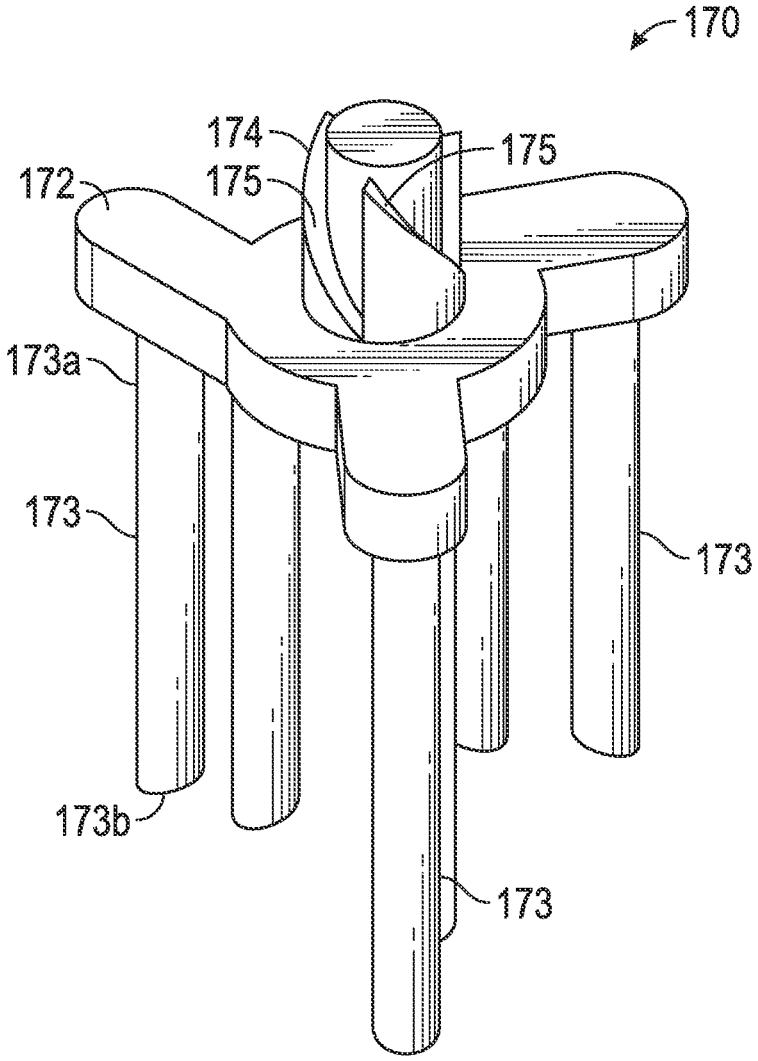
FIG. 8 is a perspective view of the torque control member of the drill bit of FIG. 3.

As best shown in FIGS. 3 and 8, each rod 173 has a first or fixed end 173*a* attached to the corresponding arm 172 and a second or free end 173*b* distal the corresponding arm 172. As will be described in more detail below, free ends 173*b* are configured to moved together axially from bit face 120, and more specifically, extend axially to varying distances from the corresponding cutter-supporting surfaces 130 of primary blades 122, 123, 124 in cone region 141. With ends 173*b* axially extended from cutter-supporting surfaces 130, the DOC of cutter elements 135 in cone region 141, and associated TOB, are limited and controlled. Thus, rods 173 and ends 173*b* may also be referred to as DOC or TOB limiting structures. In particular, with ends 173*b* axially extended, cutter elements 135 in cone region 141 can engage the formation to any DOC up to the DOC at which ends 173*b* engage and bear against the formation. Once ends 173*b* engage the formation, any further increase in the DOC is prevented. Thus, ends 173*b* may be described as having "active" positions extending axially from cutter-supporting surfaces 130, and "inactive" positions disposed at or axially withdrawn from cutter-supporting surfaces 130. Ends 173*b* are dynamically transitioned or actuated between the active and inactive positions by rotation of connection member 150 about axis 105 relative to bit body 110 and torque control member 170. Ends 173*b* are preferably biased to inactive positions with a biasing member (e.g., spring) positioned between base 171 and surface 112*a* and/or between base 171 and end 150*b*. Although ends 173*b* engage the formation in the active positions, ends 173*b* preferably do not shear or cut the formation, and thus, ends 173*b* preferably have a geometry configured to bear against and slide across the formation. In this embodiment, ends 173*b* are generally semi-flat top although other suitable geometries such as convex and dome-shaped, chisel-shaped, and flat top may also be employed.

Referring now to FIGS. 3, 5, and 7, base 171 and arms 172 of torque control member 170 are positioned proximal planar surface 112*a* with rods 173 extending through bores 147 in bit body 110. Recesses 115 on inner surface 112 of bit body 110 slidingly receive the radially outer ends of arms 172, and rods 173 slidingly engage body 110 within bores 147. As will be described in more detail below, torque control member 170 can be actuated to move axially relative to bit body 110. Sliding engagement of recesses 115 and arms 172, and sliding engagement of rods 173 and bores 147 guide the axial movement of torque control member 170 relative to bit body 110.

Rods 173 are sized such that ends 173*b* are generally positioned proximal cutter-supporting surfaces 130 of primary blades 122, 123, 124. However, relative axial movement of torque control member 170 relative to bit body 110 during drilling operations enables ends 173*b* to extend axially from the corresponding cutter-supporting surfaces 130 in cone region 141 and into engagement with the formation, as well as retract axially toward cutter-supporting surfaces 130 in cone region 141 and out of engagement with the formation.

Referring still to FIGS. 3 and 5-7, insert portion 153 of connection member 150 is disposed in receptacle 113 of bit body 110. In particular, lower end 150*b* is positioned axially adjacent base 171 and arms 172, actuation member 174 is disposed in receptacle 157 with mating helical ramps 158 in sliding engagement with mating helical ramps 175, splines 155 are disposed in recesses 116, splines 114 are disposed in recesses 156, shoulders 112*b*, 154*b* slidingly engage, surfaces 112*c*, 154*c* slidingly engage, surfaces 112*d*, 154*d* slidingly engage, and flange 152 axially abuts upper end 110*a*. A pair of annular seal assemblies are positioned between connection member 150 and bit body 110 along surfaces 112*c*, 154*c*, and further, a plurality of ball bearings 191 are disposed between opposed annular recesses along surfaces 112*c*, 154*c* to maintain the positioning of flange 152 axially adjacent end 110*a* while allowing connection member 150 to rotate about axis 105 relative to bit body 110.

As best shown in FIGS. 3 and 7, splines 114 slidingly engage cylindrical surface 154*d*, however, splines 155 are radially spaced from cylindrical surface 112*c*, resulting in a radial gap 180 between each spline 155 and surface 112*c*. Further, each spline 155 is disposed between two splines 114—a spline 114 that leads the corresponding spline 155 relative to the direction of bit rotation 106 and another spline 114 that trails the corresponding spline 155 relative to the direction of bit rotation 106. Each spline 155 circumferentially abuts the corresponding trailing spline 114, but is circumferentially-spaced apart from the corresponding leading spline 114, resulting in a circumferential gap 181 between each spline 155 and the circumferentially adjacent leading spline 114. Gaps 180, 181 are filled with a flexible, resilient material 182. In this embodiment, material 182 is an elastomeric material having a durometer hardness preferably between 85 and 100.

Referring now to FIGS. 1, 3, and 7, during drilling operations, drillstring 20 is threaded onto pin end 151, weight-on-bit (WOB) is applied as bit 100 engages the formation, and string 20 applies rotational torque to bit 100 to rotate bit 100 about axis 105 in cutting direction 106. The applied torque is transferred from connection member 150 to bit body 110 through splines 155, material 182 in gaps 181, and splines 114, resulting in torque-on-bit (TOB). At relatively low TOBs, material 182 in gaps 181 has a sufficient rigidity and hardness to resist compression, thereby preventing connection member 150 from rotating relative to bit body 110. However, as the TOB increases, material 182 in gaps 181 begins to compress and allows connection member 150 to rotate about axis 105 relative to bit body 110 to a limited extent (connection member 150 can rotate in a given direction relative to bit body 110 about axis 105 until splines 114, 155 are sufficiently close or abut each other). For example, if cutter elements 135 abruptly transition from a soft formation to a hard formation, or if the cutter elements 135 engaging the formation to a sufficiently large depth-of-cut (DOC), the TOB may increase sufficiently to compress material 182 in gaps 181, resulting in rotation of connection member 150 relative to bit body 110. Some of the material 182 in gaps 181 may be squeezed into gaps 180. In general, the greater the TOB, the greater the compression of material 182 in gaps 181 and the greater rotation of connection member 150 relative to bit body 110. The degree or amount of rotation of connection member 150 relative to bit body 110 for a given TOB can be controlled and varied, as desired, by adjusting material 182 (e.g., the hardness of material 182 in gaps 181) and/or the size and geometry of gaps 181. Thus, bit 100 can be designed to have a desired and predetermined relationship between TOB and rotation of connection member 150 relative to bit body 110.

As best shown in FIG. 5, engagement of arms 172 and recesses 115, as well as engagement of rods 173 and bores 147, prevents torque control member 170 from rotating relative to bit body 110 about axis 105. Thus, as connection member 150 rotates relative to bit body 110, connection member 150 also rotates relative to torque control member 170.

Referring again to FIGS. 1 and 3, when connection member 150 rotates relative to bit body 110 and torque control member 170 about bit axis 105, sliding engagement of mating helical ramps 158, 175 causes torque control member 170 to move axially relative to connection member 150 and bit body 110. In other words, relative rotation of connection member 150 relative to torque control member 170 actuates the axial movement of torque control member 170 relative to bit body 110. In particular, helical ramps 158, 175 are positioned and oriented such that rotation of connection member 150 in cutting direction 106 relative to bit body 110, such as would occur when the TOB increases, causes torque control member 170 to move axially downward (i.e., base 171 and arms 172 move axially away from end 150*b* and toward planar surface 112*a*); and rotation of connection member 150 in a direction opposite cutting direction 106 relative to bit body 110, such as would occur when the TOB decreases, causes torque control member 170 to move axially upward (i.e., base 171 and arms 172 move axially toward end 150*b* and away from planar surface 112*a*). Thus, the greater the TOB, the greater the axial extension of ends 173*b* from cutter-supporting surfaces 130 in cone region 141. Thus, by controlling the relationship between TOB and relative rotation of connection member 150 relative to bit body 110, the relationship between TOB and axial extension of ends 173*b* can be controlled.

In general, the greater the TOB, the greater the axial extension of ends 173*b* from cutter-supporting surfaces 130 in cone region 141. Depending on the TOB, ends 173*b* may (a) extend axially from cutter-supporting surfaces 130 but not into engagement with the formation, or (b) extend axially from cutter-supporting surfaces 130 into engagement with the formation. In the first case (a), ends 173*b* do not immediately change the DOC or TOB, but rather, limit the maximum DOC and TOB. In general, the greater the axial distance ends 173*b* extend from cutter-supporting surfaces 130 in cone region 141, the lower the maximum DOC of cutter elements 135 in cone region 141 and the lower the maximum TOB. In the second case (b), ends 173*b* limit the maximum DOC and TOB, and can also immediately decrease DOC and TOB if ends 173*b* extend sufficiently to effectively urge bit body 110 axially away from the formation. This offers the potential to enhance bit durability and operating lifetime. In particular, during drilling operations, a large spike or abrupt increase in TOB (e.g., resulting from transition from a soft to hard formation or an excessive DOC) may damage cutter elements. However, in embodiments described herein, extension of ends 173*b* limits the maximum DOC and hence TOB, and at sufficiently large TOBs, extension of ends 173*b* into engagement with the formation decreases the actual DOC and TOB.

Figure 9:
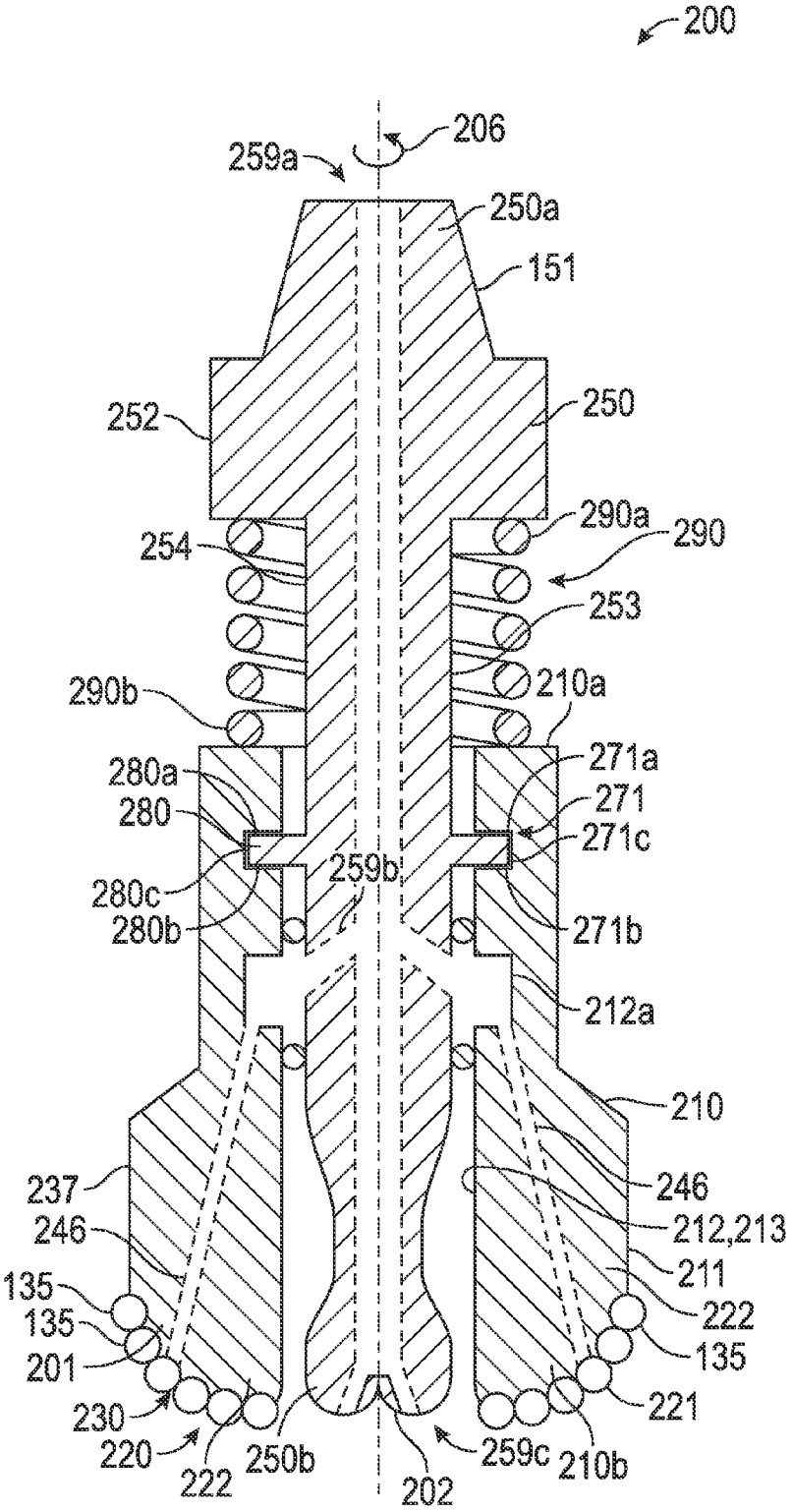
FIG. 9 is a schematic cross-sectional view of an embodiment of a drill bit in accordance with the principles described herein.

Referring now to FIG. 9, an embodiment of a drill bit 200 that can be used in the place of drill bit 100 previously described as shown. In other words, drill bit 200 can be attached to the lower end of drillstring 20 for drilling operations. In this embodiment, drill bit 200 is a hybrid bit including both a fixed cutter bit 201 and a rolling cone bit 202 moveably coupled to bit 210. In particular, bit 200 includes bit body 210, a connection member 250 rotatably coupled to bit body 210, and a biasing member 290 disposed about connection member 250 axially adjacent body 210. Body 210 includes fixed cutter bit 201, and connection member 250 includes rolling cone bit 202. In addition, bit 200 has a central or longitudinal axis 205 about which bit 200 rotates in a cutting direction represented by arrow 206. Bit body 210, connection member 250, and biasing member 290 are each coaxially aligned with axis 205. Thus, bit body 210, connection member 250, and biasing member 290 each have a central axis coincident with axis 205.

Bit body 210 has a first or upper end 210*a*, a second or lower end 210*b* opposite end 210*a*, an outer surface 211 extending between ends 210*a*, 210*b*, and an inner surface 212 defined by a through bore 213 extending axially from upper end 210*a* to lower end 210*b* and centered about axis 205 (i.e., coaxially aligned with axis 205).

Inner cylindrical surface 212 includes an annular cylindrical groove or recess 212*a* and a helical groove or recess 271 axially disposed between end 210*a* and groove 212*a*. Helical groove 271 is defined by an upper helical shoulder 271*a*, a lower helical shoulder 271*b*, and a helical cylindrical surface 271*c* extending axially between shoulders 271*a*, 271*b*. Upper and lower helical shoulders 271*a*, 271*b* are parallel.

Body 210 may be formed in a conventional manner using powdered metal tungsten carbide particles in a binder material to form a hard metal cast matrix. Alternatively, the body can be machined from a metal block, such as steel, rather than being formed from a matrix.

Referring still to FIG. 9, lower end 210*b* of bit body 210 that faces the formation comprises a bit face 220 provided with a cutting structure 221. In this embodiment, cutting structure 221 is similar to cutting structure 121 previously described. Namely, cutting structure 221 includes a plurality of angularly spaced blades 222 extending radially along bit face 220 and a plurality of cutter elements 135 as previously described mounted to the cutter-supporting surfaces 230 of blades 222. Bit body 210 also includes gage pads 237 of substantially equal axial length measured generally parallel to bit axis 205. Gage pads 237 are circumferentially-spaced about outer surface 211 of bit body 210. In this embodiment, gage pads 237 are integrally formed as part of the bit body 210. In general, gage pads 237 can help maintain the size of the borehole by a rubbing action when cutter elements 235 wear slightly under gage. Gage pads 237 also help stabilize bit 200 against vibration.

A plurality of circumferentially-spaced flow passages 246 extend axially downward and radially outward from recess 212*a* to bit face 220. Passages 246 have ports or nozzles disposed at their lowermost ends, and permit drilling fluid from drillstring 20 to flow through bit body 210 around cutting structure 221 to flush away formation cuttings during drilling and to remove heat from bit body 210.

Referring still to FIG. 9, connection member 250 has a first or upper end 250*a*, a second or lower end 250*b* opposite end 250*a*, an externally threaded pin end 151 as previously described extending axially from upper end 250*a* to an annular flange 252, and a male insert portion 253 extending axially from lower end 250*b* to annular flange 252. Upon assembly of bit 200, insert portion 253 extends through bore 213 of bit body 210.

Male insert portion 253 is generally sized and configured to mate with the contours of through bore 213 and inner surface 212 of bit body 210. In particular, insert portion 253 has an outer surface 254 including a helical external thread 280 axially disposed between flange 252 and end 250*b*. Helical thread 280 includes an upper helical shoulder 280*a*, a lower helical shoulder 280*b*, and a helical cylindrical surface 280*c* extending between shoulders 280*a*, 280*b*. Upper and lower helical shoulders 280*a*, 280*b* are parallel.

Lower end 250*b* of connection member 250 comprises rolling cone bit 202. In general, rolling cone bit 202 can be configured similar to a conventional rolling cone bit including three circumferentially spaced-apart rolling cone cutters rotatably mounted on journals. Each rolling cone includes a plurality of teeth designed to pierce and crush the formation.

Referring still to FIG. 9, connection member 250 also includes a through bore 259*a* extending axially from end 250*a*, a plurality of circumferentially-spaced flow passages 259*b* extending radially outward from through bore 259*a* to recess 212*a*, and a plurality of circumferentially-spaced flow passages 259*c* extending axially downward and radially outward from bore 259*a* to end 250*b* and rolling cone cutter 202. Bore 259*a* supplies drilling fluid from drillstring 20 to passages 259*b*, 259*c*. In turn, passages 259*b* supply drilling fluid to passages 246 in bit body 210 via groove 212*a*, and passages 259*c* provide drilling fluid to rolling cone cutter 202. Passages 259*c* have ports or nozzles disposed at their lowermost ends that permit drilling fluid to flow around the rolling cone cutters and teeth of bit 202 to flush away formation cuttings during drilling and to remove heat from bit 202.

Biasing member 290 is disposed about connection member 250 and axially disposed between annular flange 252 and upper end 210*a* of bit body 210. In particular, biasing member 290 has a first or upper end 290*a* secured to flange 252 of connection member 250 and a second or lower end 290*b* secured to upper end 210*a* of bit body 210. In addition, biasing member 290 is compressed between flange 252 and end 210*a*, thereby urging bit body 210 axially downward and away from flange 252. In this embodiment, biasing member 290 is a coil spring that functions to bias bit body 210 axially downward and away from flange 252. In addition, since ends 290*a*, 290*b* secured to flange 252 and bit body 210 respectively, biasing member 290 also operates like a torsion spring that resiliently resists bit body 210 from rotating relative to connection member 250 about axis 205.

Referring still to FIG. 9, insert portion 253 of connection member 250 is disposed in through bore 213 of bit body 210 with lower end 250*b* is positioned proximal lower end 210*b*, passages 259*b* align with groove 212*a*, helical thread 280 disposed in sliding engagement with mating helical groove 271, and biasing member 290 is disposed between flange 252 and bit body 210. Due to sliding engagement of thread 280 and groove 271, rotation of bit body 210 relative to connection member 250 results in axial movement of connection member 250 relative to bit body in one direction (e.g., downward), and rotation of bit body 210 relative to connection member 250 results in axial movement of connection member 250 relative to bit body in the opposite direction (e.g., upward). Biasing member 290 biases connection member 250 axially upward relative to bit body 210. A plurality of annular seal assemblies are provided between connection member 250 and bit body 210 to restrict the axial flow of fluids therebetween.

Referring still to FIG. 9, during drilling operations, drillstring 20 is threaded onto pin end 151, weight-on-bit (WOB) is applied as bit 200 engages the formation, and string 20 applies rotational torque to bit 200 to rotate bit 200 about axis 205 in cutting direction 206. The applied torque is transferred from connection member 250 to bit body 210 biasing member 290 and frictional engagement of helical thread 272 and helical channel 271, resulting in torque-on-bit (TOB). In particular, at relatively low TOBs, biasing member 290 resists rotation of connection member 250 relative to bit body 210. In addition, compression of biasing member 290 urges bit body 210 downward relative to connection member 250, thereby urging shoulders 271*a*, 280*a* into frictional engagement. However, as the TOB increases, it begins to exceed the relative rotation resistive forces, thereby allowing bit body 210 to rotate about axis 205 relative to connection member 250. Bit body 210 rotates relative to connection member 250 until the resistive torque exerted by biasing member and frictional engagement of shoulders 271*a*, 280*a* is sufficient to prevent relative rotation between connection member 250 and bit body 210 under the TOB. For example, if cutter elements 235 abruptly transition from a soft formation to a hard formation, or if the cutter elements 235 engaging the formation to a sufficiently large depth-of-cut (DOC), the TOB may increase sufficiently to overcome the resistance to relative rotation between connection member 250 and bit body 210. In general, the greater the TOB, the greater the rotation of connection member 250 relative to bit body 210, the greater the compression of biasing member 290, and the greater the torsional resistance of biasing member 250. The degree or amount of rotation of bit body 210 relative to connection member 250 for a given TOB can be controlled and varied, as desired, by adjusting the characteristics of biasing member 290 (e.g., the hardness of material, spring constant, number of coil turns, etc.). Thus, bit 200 can be designed to have a desired and predetermined relationship between TOB and rotation of bit body 210 relative to connection member 250.

Referring still to FIG. 9, when bit body 210 rotates relative to connection member 250 about bit axis 205, sliding engagement of mating helical thread 280 and helical channel 271 causes bit body 210 to move axially relative to connection member 250. In particular, helical thread 280 and helical channel 271 are oriented such that rotation of bit body 210 in a direction opposite cutting direction 206 relative to connection member 250, such as would occur when the TOB increases, causes bit body 210 to move axially upward relative to connection member 250 (i.e., upper end 210*a* moves axially toward flange 252); and rotation of bit body 210 in cutting direction 206 relative to connection member 250, such as would occur when the TOB decreases, causes bit body 210 to move axially downward relative to connection member 250 (i.e., upper end 210*a* moves axially away from annular flange 252). Thus, the axial position of bit body 210 along connection member 250 is a function of the TOB.

As previously described, an increase in TOB during drilling operations causes bit body 210 to move axially upward relative to connection member 250, and a decrease in TOB during drilling operations causes bit body 210 to move axially downward relative to connection member 250. As bit body 210 moves axially upward relative to connection member 250, rolling cone bit 202 effectively extends downward from bit face 220, and as bit body moves axially upward relative to connection member 250, rolling cone bit 202 effectively retracts upward toward bit face 220. Thus, as TOB increases, rolling cone bit 202 extends further from bit face 220, and as TOB decreases, rolling cone bit 202 moves closer towards bit face 220. In general, roller cone drill bits are naturally torque limiting, and thus, a sufficient increase in TOB will cause bit 200 to respond by extending rolling cone bit 202 into engagement with the formation and decrease the DOC of fixed cutter bit 201, thereby reducing TOB. Thus, extension of rolling cone bit 202 into engagement with the formation limits the DOC of cutters 135 on fixed cutter bit 201 and maximum TOB. Accordingly, rolling cone bit 202 may also be referred to as a DOC or TOB limiting structure. This offers the potential to enhance bit durability and operating lifetime.

Figure 10:
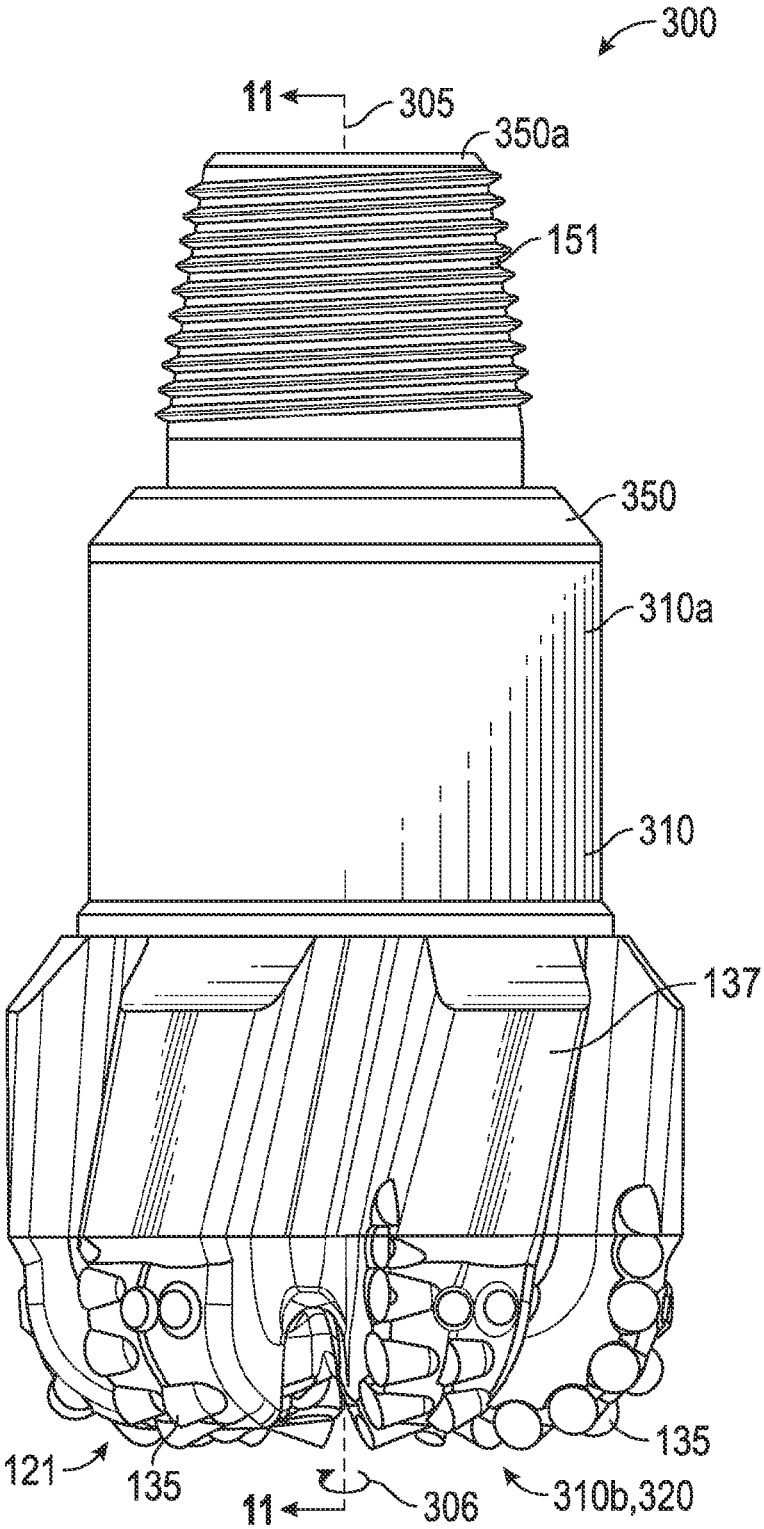
FIG. 10 is a side view of an embodiment of a drill bit in accordance with the principles described herein.
Figure 11:
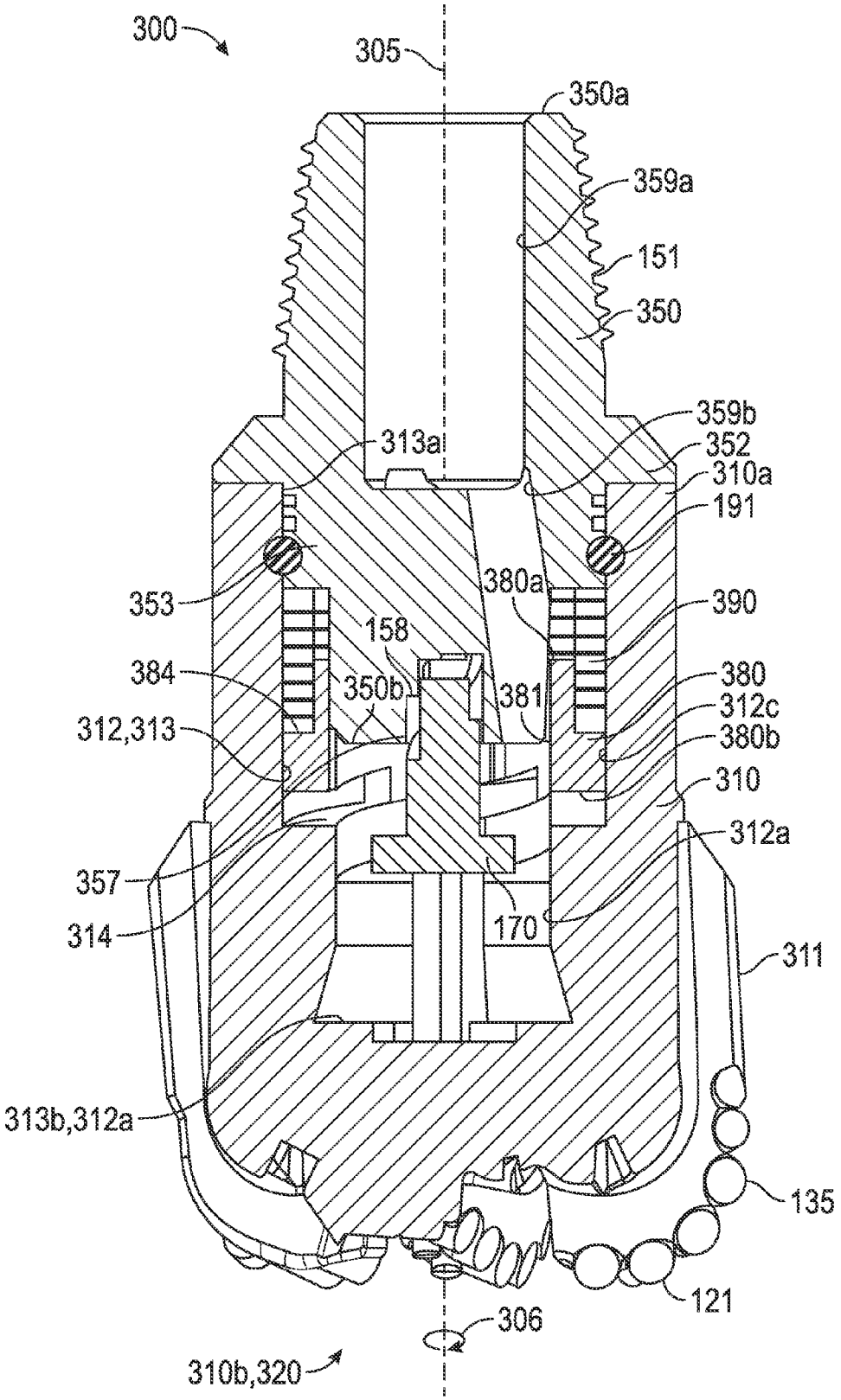
FIG. 11 is a cross-sectional view of the drill bit of FIG. 10 taken along section 11-11 of FIG. 10.
Figure 12:
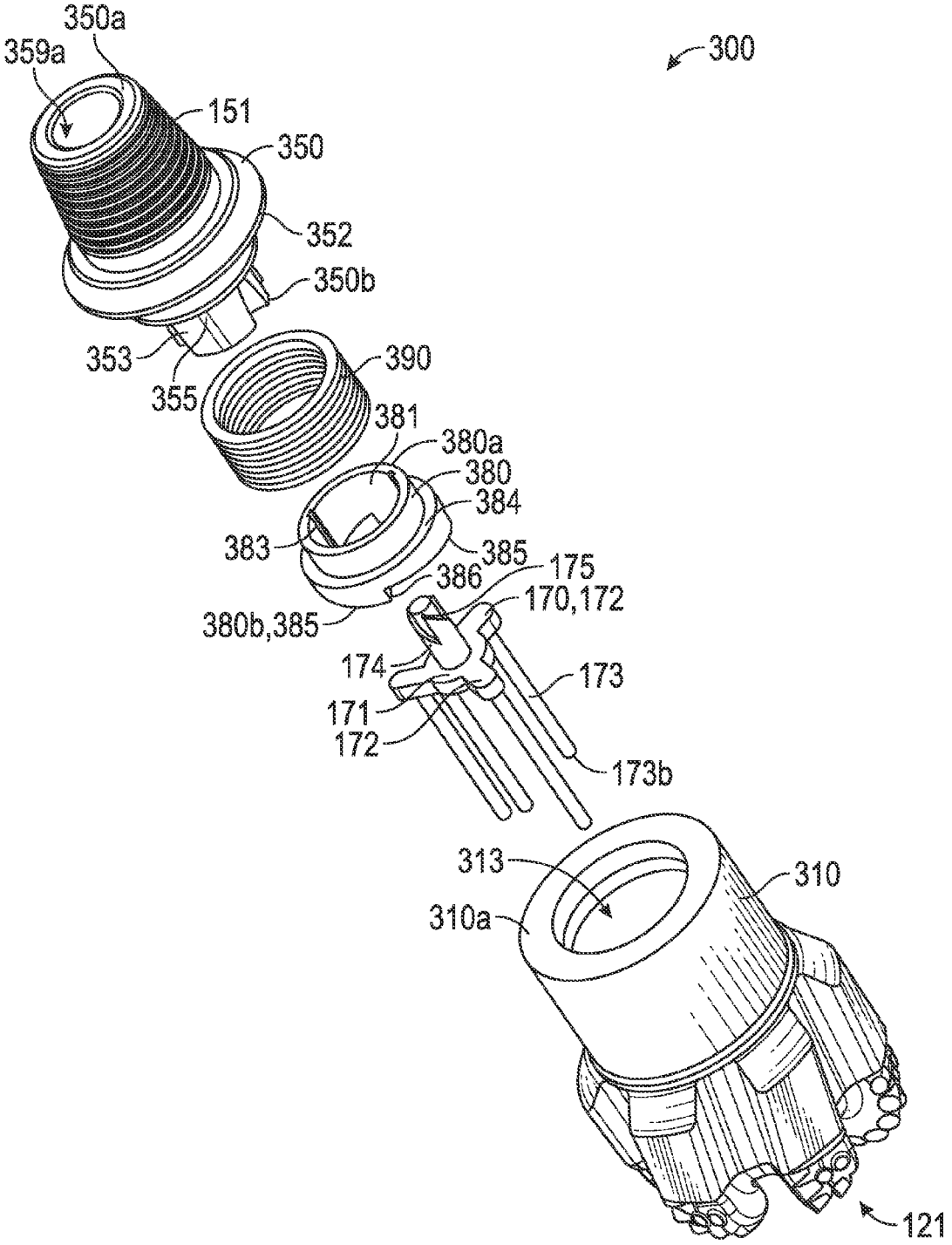
FIG. 12 is an exploded view of the drill bit of FIG. 10.

Referring now to FIGS. 10-12, an embodiment of a fixed cutter bit drill bit 300 that can be used in the place of drill bit 100 previously described as shown. In other words, drill bit 300 can be attached to the lower end of drillstring 20 for drilling operations. In this embodiment, bit 300 includes a bit body 310, a connection member 350 rotatably coupled to bit body 310, a torque control member 170 as previously described moveably coupled to body 310 and connection member 350, and an annular actuation sleeve 380 moveably coupled to body 310 and connection member 350. Bit 300 has a central or longitudinal axis 305 about which bit 300 rotates in the cutting direction represented by arrow 306. Bit body 310, connection member 350, torque control member 170, and actuation sleeve 380 are each coaxially aligned with axis 305.

Referring now to FIGS. 10-12 and 15, bit body 310 is substantially the same as bit body 110 previously described, except that bit body 310 includes helical ramps 314 instead of splines 114 and bit body 310 does not include gaps 180, 181 filled with material 182. In particular, bit body 310 has a first or upper end 310*a*, a second or lower end 310*b* opposite end 310*a*, an outer surface 311 extending between ends 310*a*, 310*b*, and an inner surface 312 defined by a generally cylindrical cavity or receptacle 313 extending axially from upper end 310*a* and centered about axis 305 (i.e., coaxially aligned with axis 305). Thus, receptacle 313 may be described as having a first or upper end 313*a* coincident with end 310*a* and a second or lower end 313*b* disposed within bit body 310 opposite end 313*a*.

Figure 15:
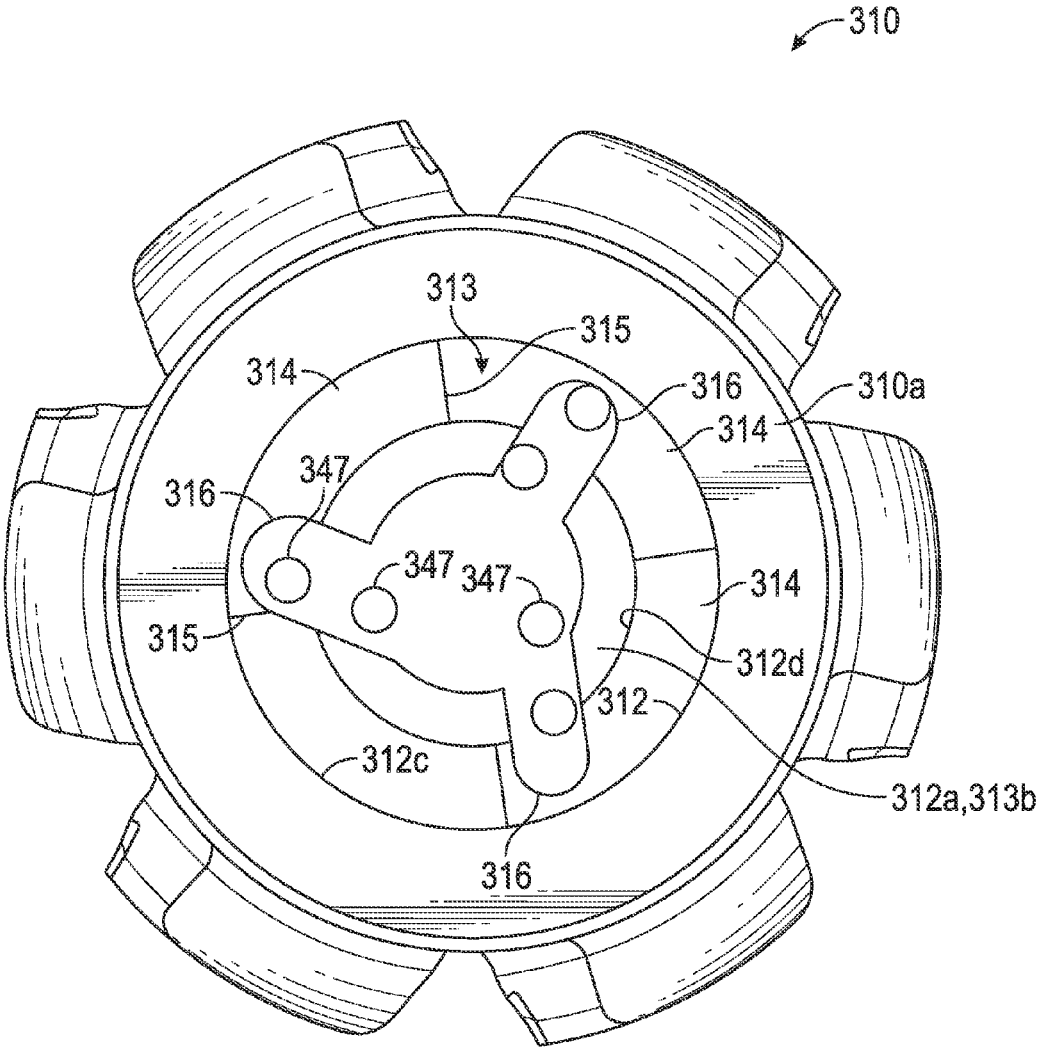
FIG. 15 is a top end view of the bit body of the drill bit of FIG. 10.

As best shown in FIG. 15, inner surface 312 includes a planar surface 312*a* defining the lower end 313*b* of receptacle 313, a plurality of circumferentially adjacent helical shoulders or ramps 314 axially positioned between end 310*a* and surface 312*a*, a cylindrical surface 312*c* extending axially from end 310*a* to ramps 314, and a generally cylindrical surface 312*d* extending axially from ramps 314 to surface 312*a*. Surface 312*a* lies in a plane oriented perpendicular to axis 305. In addition, cylindrical surface 312*d* is disposed at a radius that is less than the radius of surface 312*c*. A vertical planar shoulder 315 is formed at the intersection of each pair of circumferentially adjacent ramps 314.

Inner surface 312 also includes a plurality of uniformly circumferentially-spaced recesses 316 extending radially outward from cylindrical surface 312*d*. In this embodiment, three recesses 316 circumferentially-spaced 120° apart are provided. Recesses 316 extend axially downward from ramps 314 and have the same size and geometry.

Body 310 may be formed in a conventional manner using powdered metal tungsten carbide particles in a binder material to form a hard metal cast matrix. Alternatively, the body can be machined from a metal block, such as steel, rather than being formed from a matrix.

Referring again to FIGS. 10-12, lower end 310*b* of bit body 310 that faces the formation comprises a bit face 320 provided with a cutting structure 121 and gage pads 137, each as previously described. As best seen in FIG. 15, body 310 includes a plurality of bores 347 extending axially from surface 312*a* and receptacle 313 to cutter-supporting surfaces 130 of primary blades 122, 123, 124 in cone region 141. In this embodiment, bores 347 are arranged in three circumferentially-spaced pairs, with the two bores 347 in each pair being radially spaced apart. Thus, two radially spaced bores 347 extend through bit body 310 from receptacle 313 to cutter-supporting surface 130 of each primary blade 122, 123, 124 in cone region 141. Each bore 347 is oriented parallel to axis 305, and further, each bore 347 trails (relative to the direction of rotation 306 of bit 300) the cutter elements 135 on the same primary blade 122, 123, 124. Although each bore 347 extends to cutter-supporting surface 130 of one primary blade 122, 123, 124 in this embodiment, in other embodiments, one or more of the bores (e.g., bores 347) can be disposed between primary blades (e.g., blades 122, 123, 124). Still further, at bit face 120, any two or more bores 347 can have the same or different radial positions.

Bit body 310 also includes a plurality of circumferentially-spaced drilling fluid flow passages (not shown) extending generally axially from surface 312*a* and receptacle 313 to bit face 120. Such drilling fluid flow passages have ports or nozzles disposed at their lowermost ends, and permit drilling fluid from drillstring 20 to flow through bit body 310 around a cutting structure 121 to flush away formation cuttings during drilling and to remove heat from bit body 310.

Referring now to FIGS. 10-13, connection member 350 is substantially the same as connection member 150 previously described, except that connection member 350 includes elongate, circumferentially narrow splines 355 instead of shorter, circumferentially wide splines 155. In particular, connection member 350 includes a first or upper end 350*a*, a second or lower end 350*b* opposite end 350*b*, an externally threaded pin end 151 as previously described extending axially from upper end 350*a* to an annular flange 352, and a male insert portion 353 extending axially from lower end 350*b* to flange 352. As best shown in FIG. 11, upon assembly of bit 300, insert portion 353 is seated in receptacle 313 of bit body 310, flange 352 axially abuts upper end 310*a* of bit body 310, and pin end 151 extends axially upward from bit body 310.

Figure 13:
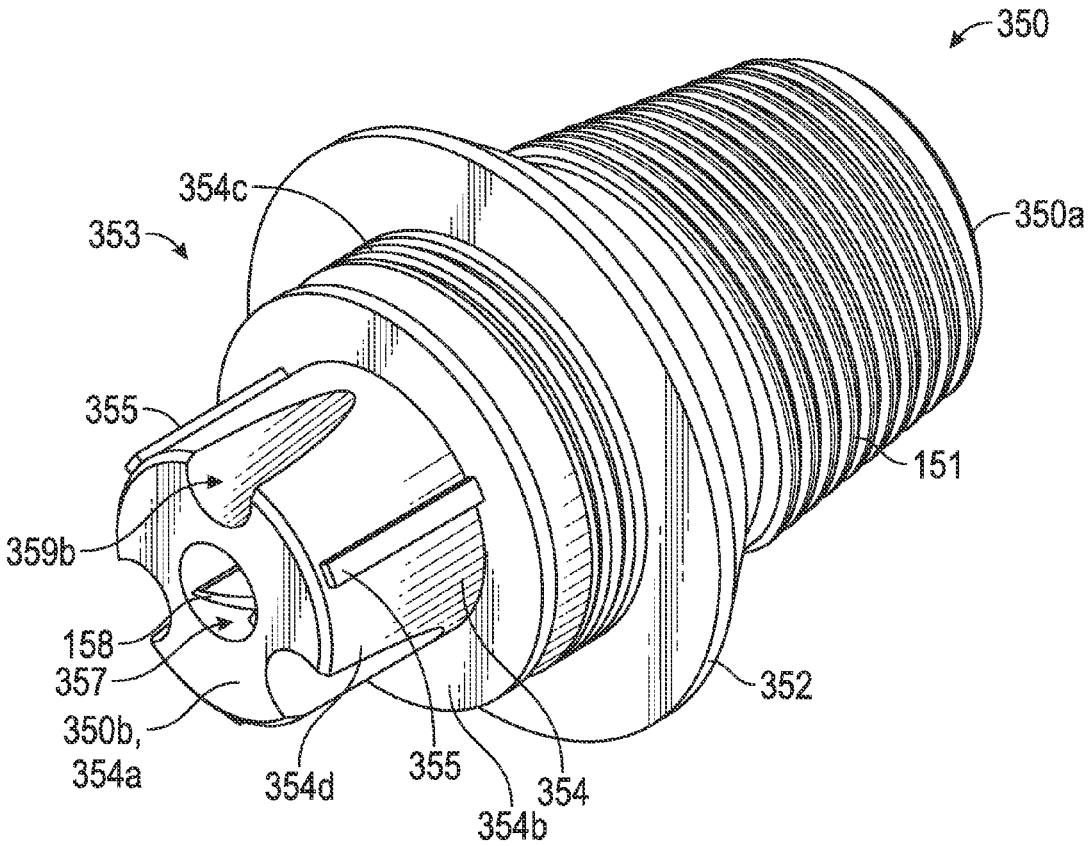
FIG. 13 is a perspective view of the connection member of the drill bit of FIG. 10.

Male insert portion 353 is generally sized and configured to mate with the contours of receptacle 313 and inner surface 312 of bit body 310. In particular, as best shown in FIG. 13, insert portion 353 has an outer surface 354 including a planar surface 354*a* defining lower end 350*b*, a planar annular shoulder 354*b* axially positioned between flange 352 and surface 354*a*, a generally cylindrical surface 354*c* extending axially from flange 352 to shoulder 354*b*, and a cylindrical surface 354*d* extending axially from shoulder 354*b* to surface 354*a*. Surfaces 354*a*, 354*b* are parallel, and each lies in a plane oriented perpendicular to axis 305. In addition, cylindrical surface 354*d* is disposed at a radius that is less than the radius of cylindrical surface 354*c*. Outer surface 354 also includes a plurality of uniformly circumferentially-spaced splines 355 extending radially outward from cylindrical surface 354*d*, and extending axially from shoulder 354*b* to lower end 350*b*. In this embodiment, three splines 355 circumferentially-spaced 120° apart are provided. Further, each spline 355 has the same size and geometry.

As best shown in FIG. 13, a generally cylindrical receptacle 357 extends axially from end 350*b* and surface 354*a* into insert portion 353. Receptacle 357 is coaxially aligned with axis 305. In this embodiment, receptacle 357 includes a plurality of circumferentially spaced helical shoulders or ramps 158 as previously described.

Referring now to FIGS. 11 and 13, connection member 350 includes a counterbore 359*a* extending axially from end 350*a* through pin end 151 and a plurality of a flow passages 359*b* extending generally axially from counterbore 359*a* through insert portion 353 to end 350*b*. In this embodiment, passages 359*b* intersect surfaces 354*a*, 354*d*. Upon assembly of bit 300, counterbore 359*a* and passages 359*b* are in fluid communication with drilling fluid flow passages in bit body 310, thereby permitting drilling fluid to flow from drillstring 20 through connection member 350 and bit body 310 to cutting structure 121.

Referring now to FIG. 12, as previously described torque control member 170 includes base 171, circumferentially-spaced arms 172 extending radially outward from base 171, radially-spaced cylindrical extension rods 173 extending axially from each arm 172, and actuation member 174 extending axially from base 171. Rods 173 and actuation member 174 are parallel to axis 305, however, rods 173 are radially spaced from axis 305 whereas actuation member 174 is coaxially aligned with axis 305. Base 171, arms 172, rods 173, and actuation member 174 are each as previously described.

Torque control member 170 functions in the same manner in bit 300 as in bit 100 previously described to limit and control DOC and TOB. Namely, free ends 173*b* are configured to moved together axially from bit face 120 of bit body 310, and more specifically, extend axially to varying distances from cutter-supporting surfaces 130 of primary blades 122, 123, 124 in cone region 141. With ends 173*b* axially extended from cutter-supporting surfaces 130, the DOC of cutter elements 135 in cone region 141, and associated TOB, are limited and controlled.

Figure 14:
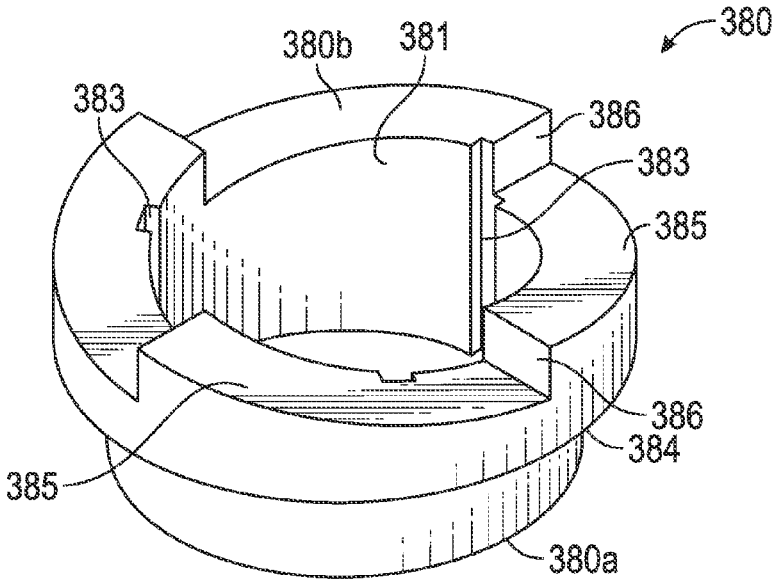
FIG. 14 is a perspective view of the actuation sleeve of the drill bit of FIG. 10.

Referring now to FIGS. 11, 12, and 14, actuation sleeve 380 is disposed about insert portion 353 of connection member 350 and is axially disposed between shoulder 354*b* and ramps 314 inside receptacle 313 of bit body 310. Annular sleeve 380 has a first or upper end 380*a*, a second or lower end 380*b* opposite end 380*a*, a cylindrical radially inner surface 381 extending axially between ends 380*a, b*, and a radially outer surface 382 extending axially between ends 380*a, b*. Inner surface 381 includes a plurality of circumferentially-spaced recesses 383. Each recess 383 extends axially between ends 380*a, b* and slidingly engages one mating spline 355 on insert portion 353. Engagement of splines 355 and recesses 383 allow sleeve 380 to move axially along insert portion 353 relative to connection member 350, but prevent sleeve 380 from moving rotationally about axis 305 relative to connection member 350. Outer surface 382 includes an annular, planar shoulder 384 between ends 380*a, b*. In addition, lower end 380*b* comprises a plurality of circumferentially adjacent helical ramps 385. A vertical planar shoulder 386 is formed at the intersection of each pair of circumferentially adjacent ramps 385. Ramps 385 are sized and configured to mate and slidingly engage ramps 314, and shoulders 386 are sized and configured to circumferentially abut and engage mating shoulders 315. Thus, in this embodiment, three helical ramps 385 are provided, each ramp 385 slidingly engages one mating ramp 314 of bit body 310.

Referring now to FIGS. 11, 12, and 15, similar to bit 100 previously described, in this embodiment, arms 172 are disposed in recesses 316 with rods 173 extending through bores 347 in bit body 310. Base 171 and arms 172 is biased axially upward and generally away from lower end 313*b* with a biasing member (not shown) such as a coil spring. As will be described in more detail below, torque control member 170 can be actuated to move axially relative to bit body 310. Sliding engagement of recesses 316 and arms 172, and sliding engagement of rods 173 and bores 347 guide the axial movement of torque control member 170 relative to bit body 310. Rods 173 are sized such that ends 173*b* are generally positioned proximal cutter-supporting surfaces 130 of primary blades 122, 123, 124 with base 171 axially spaced above lower end 313*b* of receptacle 313, but can be urged axially downward (by overcoming the biasing force) into engagement with the formation as base 171 moves axially towards lower end 313*b*.

An annular biasing member 390 and sleeve 380 are disposed about insert portion 353. In particular, biasing member 390 is mounted to insert portion 353 axially adjacent shoulder 354*b*, and then sleeve 380 is axially advanced onto lower end 350*b* via engagement of mating splines 355 and recesses 383. Thus, biasing member 390 is axially disposed between shoulders 354*b*, 384. With bit 300 fully assembled as described below, biasing member 390 is compressed between shoulders 354*b*, 384 and biases sleeve 380 axially downward away from shoulder 354*b*. In this embodiment, biasing member 390 is a coil spring.

Referring still to FIGS. 11, 12, and 15, with biasing member 390 and sleeve 380 mounted to insert portion 353, and arms 172 are seated in recesses 316 with rods 173 disposed in bores 347, insert portion 353 is axially inserted and advanced into receptacle 313 of bit body 310 until flange 352 axially abuts upper end 310*a*. As insert portion 353 is inserted into receptacle 313, actuation member 174 of torque control member 170 is received by receptacle 357. Torque control member 170 is biased upward to bring ramps 158, 175 into sliding engagement. Biasing member 390 and sleeve 380 are sized, positioned, and configured such that ramps 385 axially abut and slidingly engage mating ramps 314 of bit body 310, shoulders 386 are circumferentially adjacent corresponding shoulders 315, and biasing member 390 is compressed between shoulders 354*b*, 384, when flange 352 is axially adjacent upper end 310*a*.

As with bit 100 previously described, in this embodiment, a pair of annular seal assemblies are positioned between connection member 350 and bit body 310 along surfaces 312*c*, 354*c*, and further, a plurality of ball bearings 191 are disposed between opposed annular recesses along surfaces 312*c*, 354*c* to maintain the positioning of flange 352 axially adjacent end 310*a* while allowing connection member 350 to rotate about axis 305 relative to bit body 310.

Referring now to FIGS. 11 and 12, during drilling operations, drillstring 20 is threaded onto pin end 151, weight-on-bit (WOB) is applied as bit 300 engages the formation, and string 20 applies rotational torque to bit 300 to rotate bit 300 about axis 305 in cutting direction 306. The applied torque is transferred from connection member 350 to bit body 310 through sleeve 380 via engagement of splines 355 and recesses 383 and frictional engagement of ramps 314, 385, resulting in torque-on-bit (TOB). At relatively low TOBs, biasing member 390 is sufficiently strong (i.e., generates sufficient biasing force) to resist compression and generate sufficient static friction between ramps 314, 385 to prevent relative movement between ramps 314, 385, thereby preventing connection member 350 from rotating relative to bit body 310. However, as the TOB increases, the static friction between ramps 314, 385 is overcome, thereby allowing ramps 314 to begin moving relative to ramps 385, compressing biasing member 390 as sleeve 380 moves upward along splines 355, and allowing connection member 350 to rotate about axis 305 relative to bit body 310 to a limited extent. For example, if cutter elements 135 abruptly transition from a soft formation to a hard formation, or if the cutter elements 135 engaging the formation to a sufficiently large depth-of-cut (DOC), the TOB may increase sufficiently to overcome the static friction between ramps 314, 385, resulting in rotation of connection member 350 relative to bit body 310. In general, once the static friction between ramps 314, 385 is overcome, the greater the TOB, the greater the compression of biasing member 380 and the greater rotation of connection member 350 relative to bit body 310. The degree or amount of rotation of connection member 350 relative to bit body 310 for a given TOB can be controlled and varied, as desired, by adjusting the resiliency and spring force generated by biasing member 380 and/or the coefficient of friction between the surfaces of ramps 314, 385. Thus, bit 300 can be designed to have a desired and predetermined relationship between TOB and rotation of connection member 350 relative to bit body 310.

As with bit 100 previously described, in this embodiment of bit 300, engagement of arms 172 and recesses 315, as well as engagement of rods 173 and bores 347, prevents torque control member 170 from rotating relative to bit body 310 about axis 305. Thus, as connection member 350 rotates relative to bit body 310, connection member 350 also rotates relative to torque control member 170. The rotation of connection member 350 relative to bit body 310 and torque control member 170 about bit axis 305 and sliding engagement of mating helical ramps 158, 175 causes torque control member 170 to move axially relative to connection member 350 and bit body 310. In other words, relative rotation of connection member 350 relative to torque control member 170 actuates the axial movement of torque control member 170 relative to bit body 310. In particular, helical ramps 158, 175 are positioned and oriented such that rotation of connection member 350 in cutting direction 306 relative to bit body 310, such as would occur when the TOB increases, causes torque control member 170 to move axially downward (i.e., base 171 and arms 172 move axially away from end 350*b* and toward planar surface 312*a*); and rotation of connection member 350 in a direction opposite cutting direction 306 relative to bit body 310, such as would occur when the TOB decreases, causes torque control member 170 to move axially upward (i.e., base 171 and arms 172 move axially toward end 350*b* and away from planar surface 312*a*). Thus, the greater the TOB, the greater the axial extension of ends 173*b* from cutter-supporting surfaces 130 in cone region 141. Thus, by controlling the relationship between TOB and relative rotation of connection member 350 relative to bit body 310, the relationship between TOB and axial extension of ends 173*b* can be controlled.

In general, the greater the TOB, the greater the axial extension of ends 173*b* from cutter-supporting surfaces 130 in cone region 141. Depending on the TOB, ends 173*b* may (a) extend axially from cutter-supporting surfaces 130 but not into engagement with the formation, or (b) extend axially from cutter-supporting surfaces 130 into engagement with the formation. In the first case (a), ends 173*b* do not immediately change the DOC or TOB, but rather, limit the maximum DOC and TOB. In general, the greater the axial distance ends 173*b* extend from cutter-supporting surfaces 130 in cone region 141, the lower the maximum DOC of cutter elements 135 in cone region 141 and the lower the maximum TOB. In the second case (b), ends 173*b* limit the maximum DOC and TOB, and can also immediately decrease DOC and TOB if ends 173*b* extend sufficiently to effectively urge bit body 110 axially away from the formation. This offers the potential to enhance bit durability and operating lifetime. In particular, during drilling operations, a large spike or abrupt increase in TOB (e.g., resulting from transition from a soft to hard formation or an excessive DOC) may damage cutter elements. However, in embodiments described herein, extension of ends 173*b* limits the maximum DOC and hence TOB, and at sufficiently large TOBs, extension of ends 173*b* into engagement with the formation decreases the actual DOC and TOB.

Figure 16:
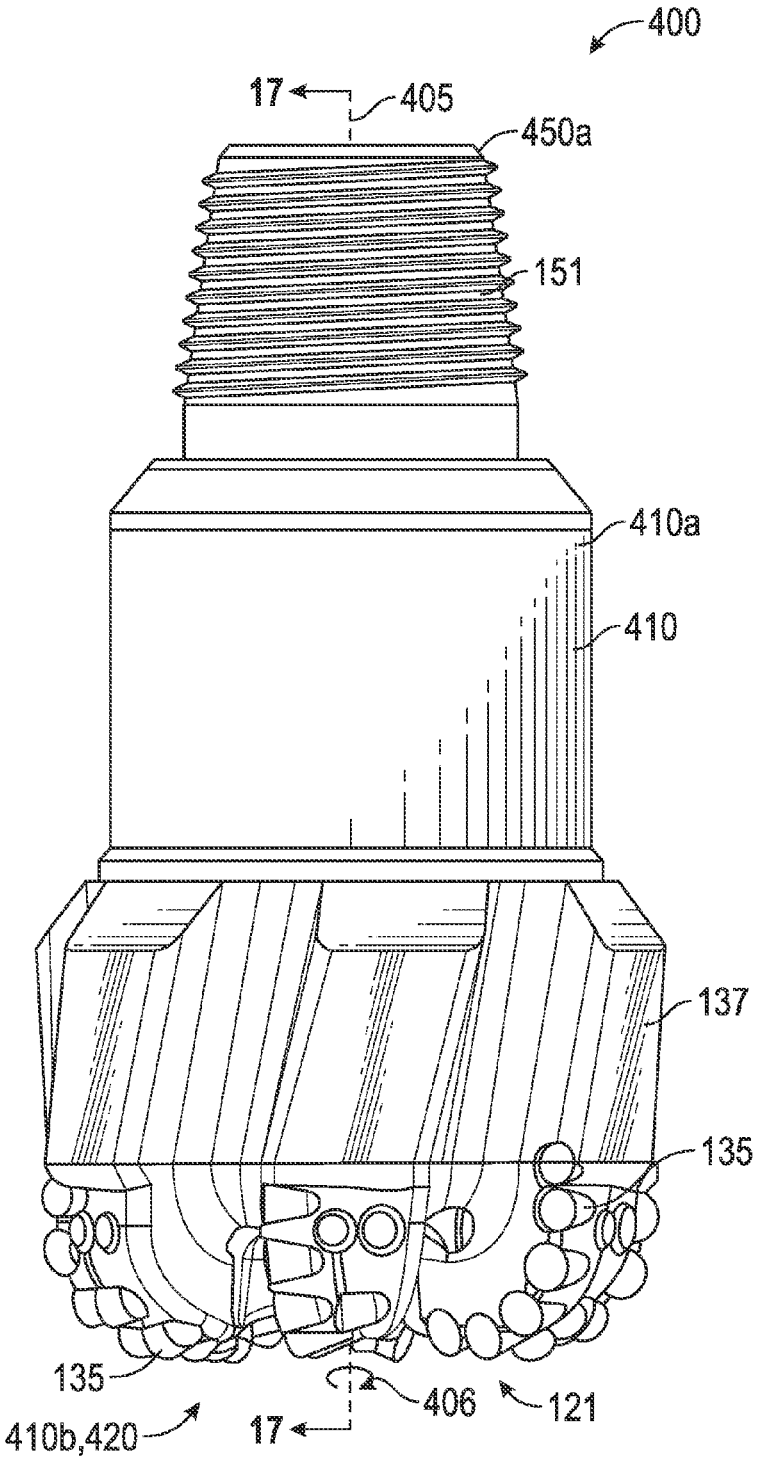
FIG. 16 is a side view of an embodiment of a drill bit in accordance with the principles described herein.
Figure 17:
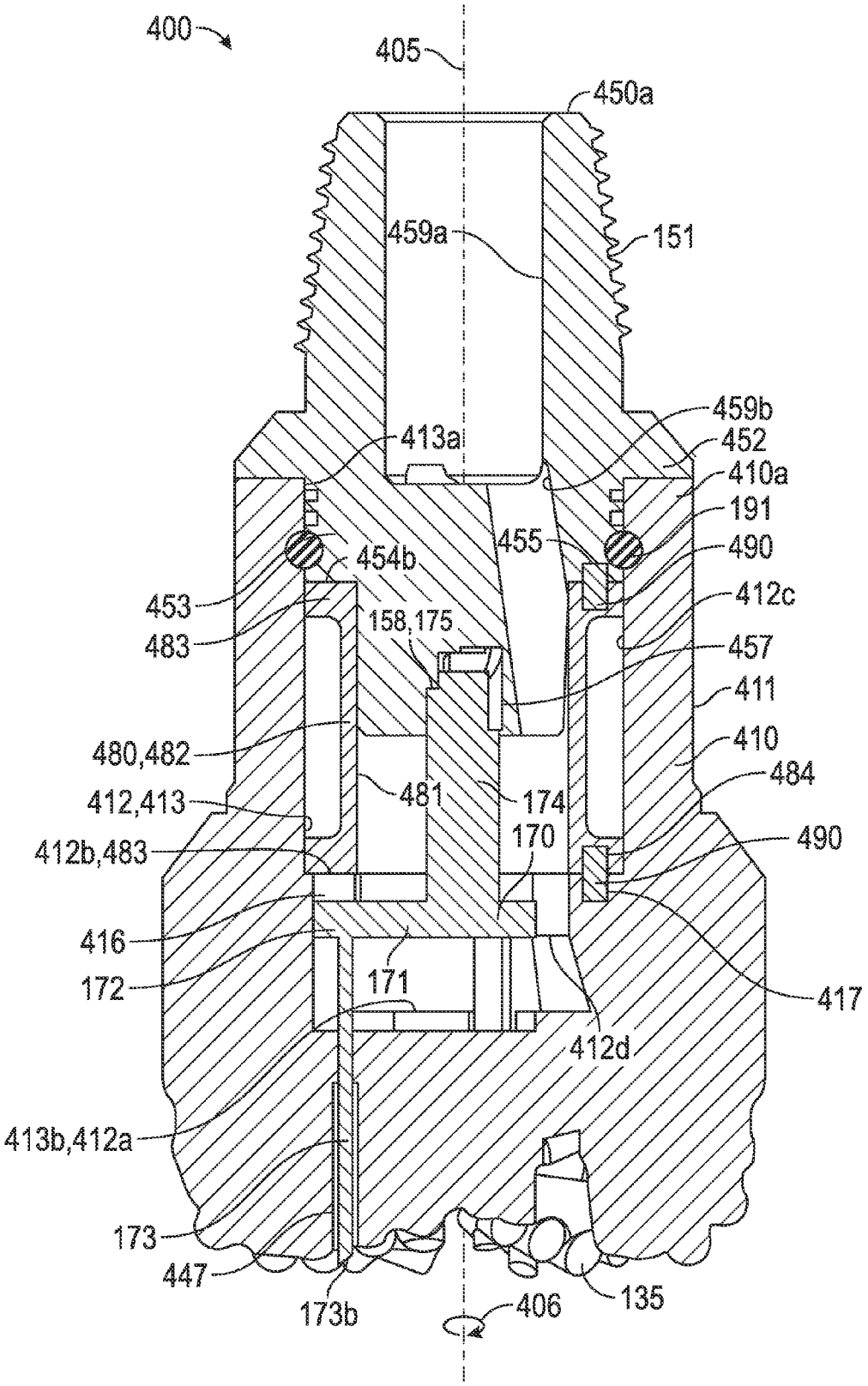
FIG. 17 is a cross-sectional view of the drill bit of FIG. 10 taken along section 16-16 of FIG. 16.
Figure 18:
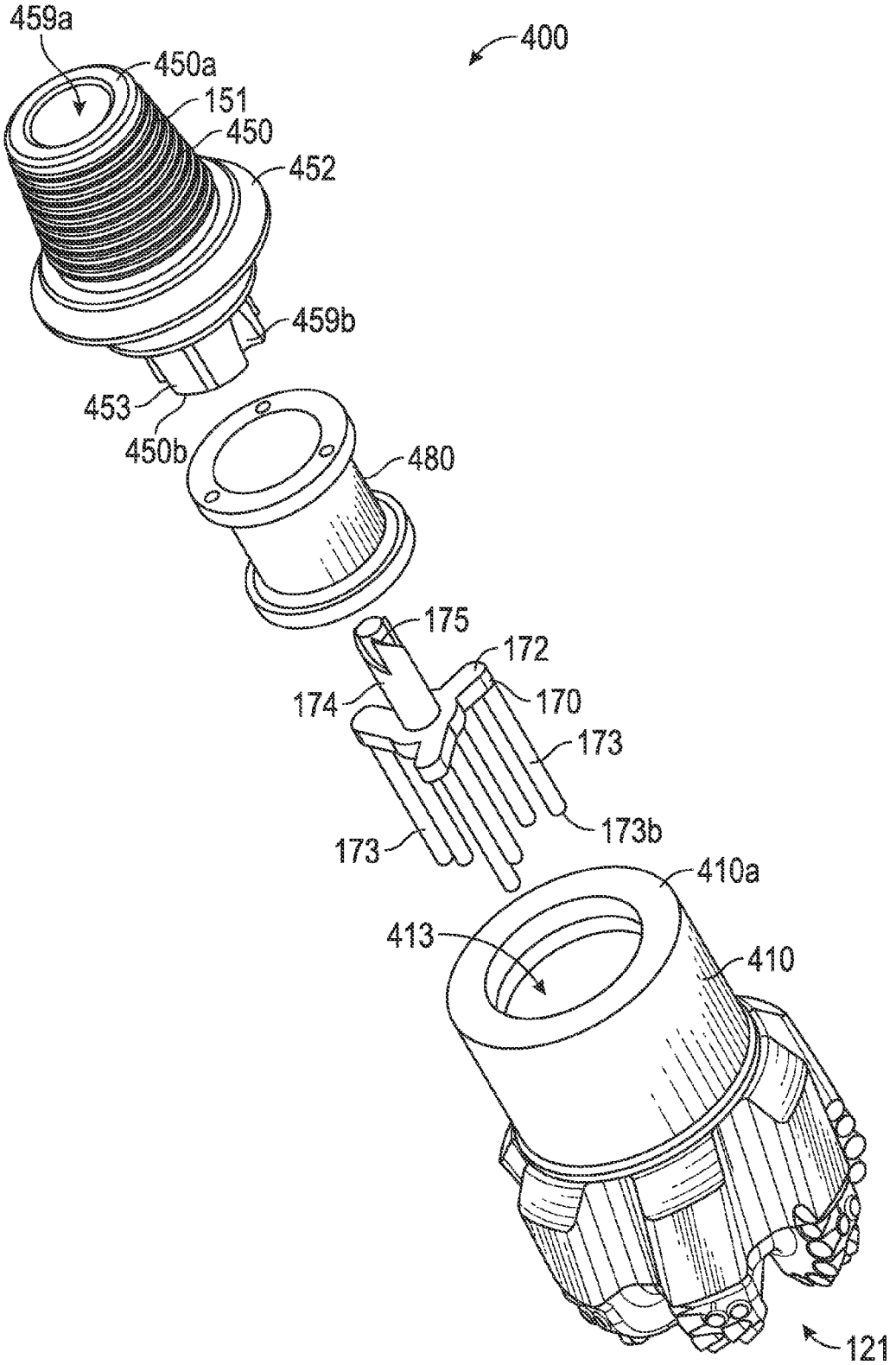
FIG. 18 is an exploded view of the drill bit of FIG. 16.

Referring now to FIGS. 16-18, an embodiment of a fixed cutter bit drill bit 400 that can be used in the place of drill bit 100 previously described as shown. In other words, drill bit 400 can be attached to the lower end of drillstring 20 for drilling operations. In this embodiment, bit 400 includes a bit body 410, a connection member 450 rotatably coupled to bit body 410, a torque control member 170 as previously described moveably coupled to body 310 and connection member 450, and a torsional biasing member 480 coupled to body 310 and connection member 450. Bit 400 has a central or longitudinal axis 405 about which bit 400 rotates in the cutting direction represented by arrow 406. Bit body 410, connection member 450, torque control member 170, and torsional biasing member 480 are each coaxially aligned with axis 405.

Referring now to FIGS. 16-18 and 21, bit body 410 is substantially the same as bit body 110 previously described, except that bit body 410 does not include splines 114 or gaps 180, 181 filled with material 182. In particular, bit body 410 has a first or upper end 410*a*, a second or lower end 410*b* opposite end 410*a*, an outer surface 411 extending between ends 410*a*, 410*b*, and an inner surface 412 defined by a generally cylindrical cavity or receptacle 413 extending axially from upper end 410*a* and centered about axis 405 (i.e., coaxially aligned with axis 405). Thus, receptacle 413 may be described as having a first or upper end 413*a* coincident with end 410*a* and a second or lower end 413*b* disposed within bit body 410 opposite end 413*a*.

Figure 21:
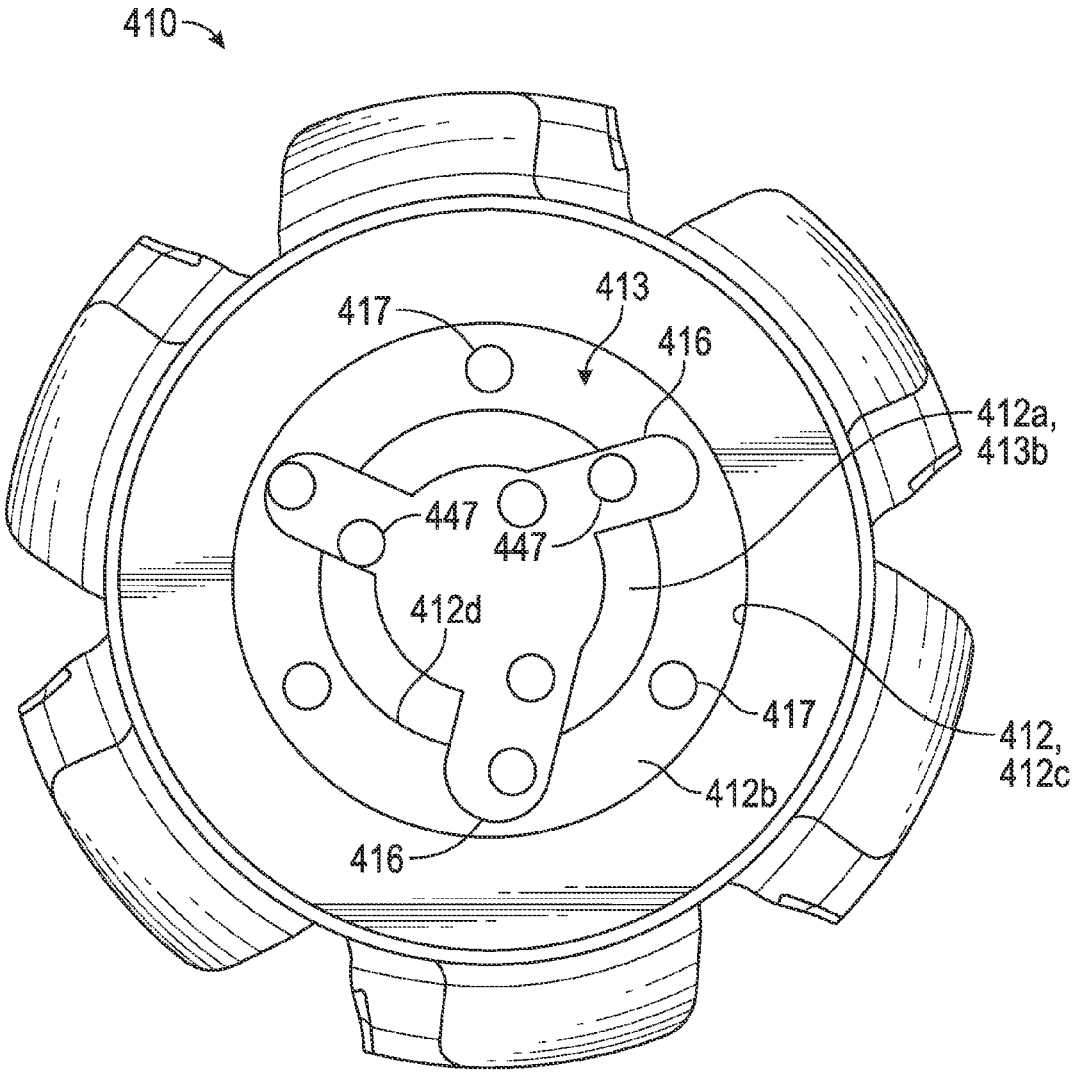
FIG. 21 is a top end view of the bit body of the drill bit of FIG. 16.

As best shown in FIGS. 17 and 21, inner surface 412 includes a planar surface 412*a* defining the lower end 413*b* of receptacle 413, an annular planar shoulder 412*b* axially positioned between end 410*a* and surface 412*a*, a cylindrical surface 412*c* extending axially from end 410*a* to shoulder 412*b*, and a generally cylindrical surface 412*d* extending axially from shoulder 412*b* to surface 412*a*. Surfaces 412*a*, 412*b* each lie in a plane oriented perpendicular to axis 405. In addition, cylindrical surface 412*d* is disposed at a radius that is less than the radius of surface 412*c*.

Inner surface 412 also includes a plurality of uniformly circumferentially-spaced recesses 416 extending radially outward from cylindrical surface 412*d*. In this embodiment, three recesses 416 circumferentially-spaced 120° apart are provided. Recesses 416 extend axially downward from shoulder 412*b* and have the same size and geometry. In addition, a plurality of circumferentially-spaced counterbores 417 extend axially from shoulder 412*b*.

Body 410 may be formed in a conventional manner using powdered metal tungsten carbide particles in a binder material to form a hard metal cast matrix. Alternatively, the body can be machined from a metal block, such as steel, rather than being formed from a matrix.

Referring again to FIGS. 16-18, lower end 410*b* of bit body 410 that faces the formation comprises a bit face 420 provided with a cutting structure 121 and gage pads 137, each as previously described. As best seen in FIGS. 17 and 21, body 410 includes a plurality of bores 447 extending axially from surface 412*a* and receptacle 413 to cutter-supporting surfaces 130 of primary blades 122, 123, 124 in cone region 141. In this embodiment, bores 447 are arranged in three circumferentially-spaced pairs, with the two bores 447 in each pair being radially spaced apart. Thus, two radially spaced bores 447 extend through bit body 410 from receptacle 413 to cutter-supporting surface 130 of each primary blade 122, 123, 124 in cone region 141. Each bore 447 is oriented parallel to axis 405, and further, each bore 447 trails (relative to the direction of rotation 406 of bit 400) the cutter elements 135 on the same primary blade 122, 123, 124. Although each bore 447 extends to cutter-supporting surface 130 of one primary blade 122, 123, 124 in this embodiment, in other embodiments, one or more of the bores (e.g., bores 447) can be disposed between primary blades (e.g., blades 122, 123, 124). Still further, at bit face 120, any two or more bores 447 can have the same or different radial positions.

Bit body 410 also includes a plurality of circumferentially-spaced drilling fluid flow passages (not shown) extending generally axially from surface 412*a* and receptacle 413 to bit face 120. Such drilling fluid flow passages have ports or nozzles disposed at their lowermost ends, and permit drilling fluid from drillstring 20 to flow through bit body 410 around a cutting structure 121 to flush away formation cuttings during drilling and to remove heat from bit body 410.

Referring now to FIGS. 16-19, connection member 450 is substantially the same as connection member 350 previously described, except that connection member 450 does not include include splines 355. In particular, connection member 450 includes a first or upper end 450*a*, a second or lower end 450*b* opposite end 450*b*, an externally threaded pin end 151 as previously described extending axially from upper end 450*a* to an annular flange 452, and a male insert portion 453 extending axially from lower end 450*b* to flange 452. As best shown in FIG. 17, upon assembly of bit 400, insert portion 453 is seated in receptacle 413 of bit body 410, flange 452 axially abuts upper end 410*a* of bit body 410, and pin end 151 extends axially upward from bit body 410.

Male insert portion 453 is generally sized and configured to mate with the contours of receptacle 413 and inner surface 412 of bit body 410. In particular, insert portion 453 has an outer surface 454 including a planar surface 454*a* defining lower end 450*b*, a planar annular shoulder 454*b* axially positioned between flange 452 and surface 454*a*, a cylindrical surface 454*c* extending axially from flange 452 to shoulder 454*b*, and a cylindrical surface 454*d* extending axially from shoulder 454*b* to surface 454*a*. Surfaces 454*a*, 454*b* are parallel, and each lies in a plane oriented perpendicular to axis 305. In addition, cylindrical surface 454*d* is disposed at a radius that is less than the radius of cylindrical surface 454*c*. A plurality of circumferentially-spaced counterbores 455 extend axially from shoulder 454*b*.

Figure 19:
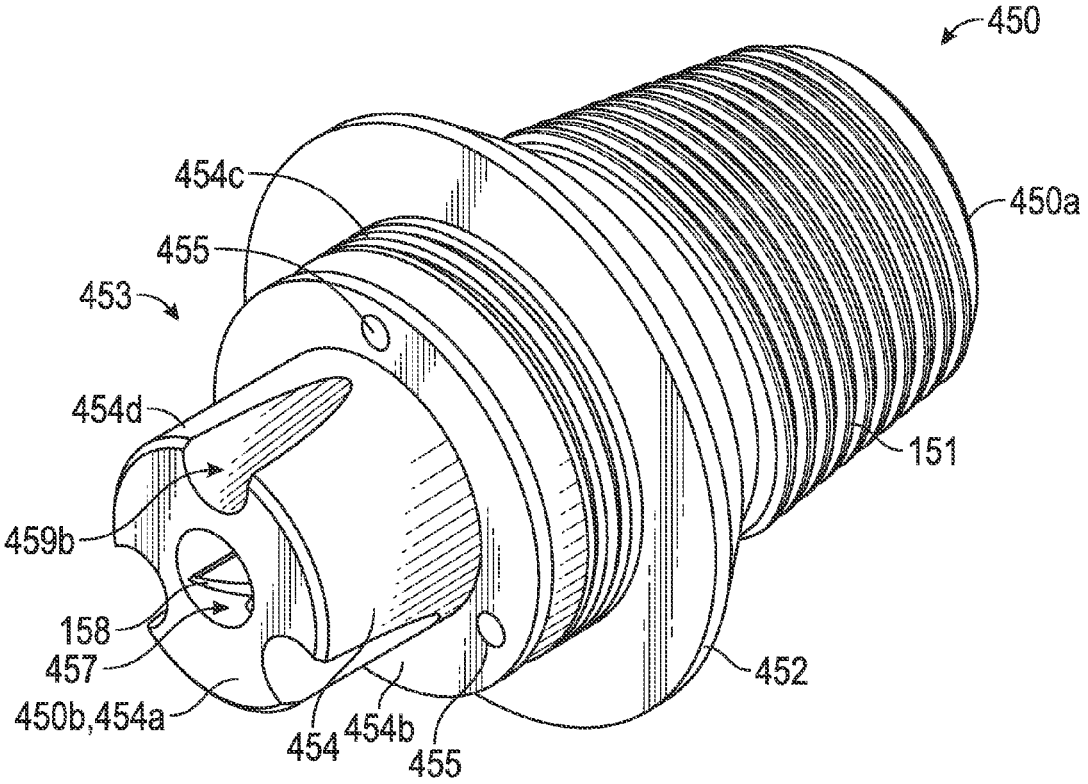
FIG. 19 is a perspective view of the connection member of the drill bit of FIG. 16.

As best shown in FIG. 19, a generally cylindrical receptacle 457 extends axially from end 450*b* and surface 454*a* into insert portion 453. Receptacle 457 is coaxially aligned with axis 405. In this embodiment, receptacle 457 includes a plurality of circumferentially spaced helical shoulders or ramps 158 as previously described.

Referring now to FIGS. 17-19, connection member 450 includes a counterbore 459*a* extending axially from end 450*a* through pin end 151 and a plurality of a flow passages 459*b* extending generally axially from counterbore 459*a* through insert portion 453 to end 450*b*. In this embodiment, passages 459*b* intersect surfaces 454*a*, 454*d*. Upon assembly of bit 400, counterbore 459*a* and passages 459*b* are in fluid communication with drilling fluid flow passages in bit body 410, thereby permitting drilling fluid to flow from drillstring 20 through connection member 450 and bit body 410 to cutting structure 121.

Referring now to FIG. 18, as previously described torque control member 170 includes base 171, circumferentially-spaced arms 172 extending radially outward from base 171, radially-spaced cylindrical extension rods 173 extending axially from each arm 172, and actuation member 174 extending axially from base 171. Rods 173 and actuation member 174 are parallel to axis 305, however, rods 173 are radially spaced from axis 305 whereas actuation member 174 is coaxially aligned with axis 305. Base 171, arms 172, rods 173, and actuation member 174 are each as previously described.

Torque control member 170 functions in the same manner in bit 400 as in bit 100 previously described to limit and control DOC and TOB. Namely, free ends 173*b* are configured to moved together axially from bit face 120 of bit body 410, and more specifically, extend axially to varying distances from cutter-supporting surfaces 130 of primary blades 122, 123, 124 in cone region 141. With ends 173*b* axially extended from cutter-supporting surfaces 130, the DOC of cutter elements 135 in cone region 141, and associated TOB, are limited and controlled.

Figure 20:
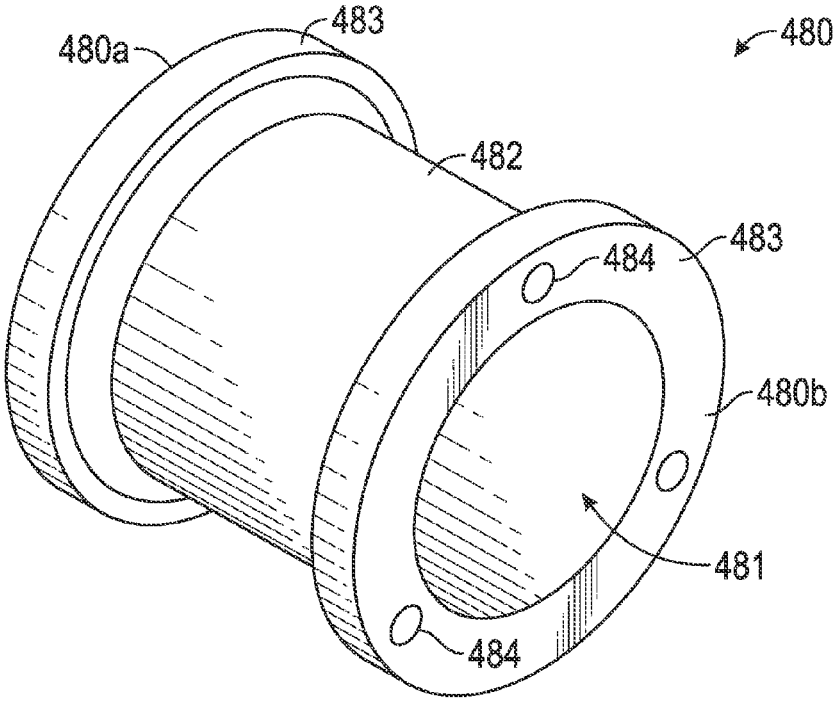
FIG. 20 is a perspective view of the torsional biasing member of the drill bit of FIG. 16.

Referring now to FIGS. 17, 18, and 20, torsional biasing member 480 is disposed about insert portion 453 of connection member 450 and is axially disposed between shoulders 412*b*, 454*b*. Biasing member 480 has a first or upper end 480*a*, a second or lower end 480*b* opposite end 480*a*, and a throughbore 481 extending axially between ends 480*a*, *b*. In this embodiment, biasing member 480 includes a torsion spring 482 and a pair of connection flanges 483 attached to the ends of torsion spring 482. Thus, flanges 483 are disposed at ends 480*a*, *b* and torsion spring 482 extends axially between flanges 483. Each flange 483 includes a plurality of circumferentially spaced counterbores 484 extending axially from ends 480*a*, *b*. Torsion spring 482 is a resilient spring that resists relative rotation between flanges 483 about axis 405.

Referring now to FIGS. 17 and 18, similar to bit 100 previously described, in this embodiment, arms 172 are disposed in recesses 416 with rods 173 extending through bores 447 in bit body 410. Base 171 is biased axially away from lower end 413*b* of recess 413 with a biasing member (not shown) such as a coil spring. As will be described in more detail below, torque control member 170 can be actuated to move axially relative to bit body 410. Sliding engagement of recesses 416 and arms 172, and sliding engagement of rods 173 and bores 447 guide the axial movement of torque control member 170 relative to bit body 410. Rods 173 are sized such that ends 173*b* are generally positioned proximal cutter-supporting surfaces 130 of primary blades 122, 123, 124 with base 171 axially spaced above lower end 413*b* of receptacle 413, but can be urged axially downward (by overcoming the biasing force) into engagement with the formation as base 171 moves axially towards lower end 413*b*.

Torsional biasing member 480 is also disposed in receptacle 413 with flange 483 at lower end 480*b* seated against annular shoulder 412*b*. Counterbores 484 in flange 483 at lower end 480*b* and counterbores 417 in shoulder 412*b* are sized and positioned such that each counterbore 484 is coaxially aligned with one counterbore 417. A pin 490 is seated in each counterbore 417 and extends into the corresponding counterbore 484, thereby preventing flange 483 at lower end 480*b* from rotating relative to bit body 410.

Referring still to FIGS. 17 and 18, with torque control member 170 and torsional biasing member 480 seated in receptacle 313, insert portion 453 is axially inserted and advanced into throughbore 481 of member 480 and receptacle 413 of bit body 410 until flange 452 axially abuts upper end 410*a*. Counterbores 484 in flange 483 at upper end 480*a* and counterbores 455 in shoulder 454*b* are sized and positioned such that each counterbore 455 is coaxially aligned with one counterbore 484. A pin 490 is seated in each counterbore 455 and extends into the corresponding counterbore 484, thereby preventing flange 483 at upper end 480*a* from rotating relative to connection member 450. As insert portion 453 is inserted into throughbore 481 and receptacle 413, actuation member 174 of torque control member 170 is received by receptacle 457. Torque control member 170 is biased upward to bring ramps 158, 175 into sliding engagement.

As with bit 100 previously described, in this embodiment, a pair of annular seal assemblies are positioned between connection member 450 and bit body 410 along surfaces 412*c*, 454*c*, and further, a plurality of ball bearings 191 are disposed between opposed annular recesses along surfaces 412*c*, 454*c* to maintain the positioning of flange 452 axially adjacent end 410*a* while allowing connection member 450 to rotate about axis 405 relative to bit body 410.

Referring now to FIGS. 16 and 17, during drilling operations, drillstring 20 is threaded onto pin end 151, weight-on-bit (WOB) is applied as bit 400 engages the formation, and string 20 applies rotational torque to bit 400 to rotate bit 400 about axis 405 in cutting direction 406. The applied torque is transferred from connection member 450 to bit body 410 through pins 490 and torsional biasing member 480, resulting in torque-on-bit (TOB). At relatively low TOBs, torsional spring 482 is sufficiently strong (i.e., generates sufficient torsional biasing force) to resist rotation of upper end 480*a* and associated flange 483 relative to lower end 480*b* and associated flange 483, thereby preventing connection member 450 from rotating relative to bit body 410. However, as the TOB increases, the torsional biasing force generated by torsional spring 482 is overcome, thereby allowing connection member 450 to rotate about axis 405 relative to bit body 410 to a limited extent. For example, if cutter elements 135 abruptly transition from a soft formation to a hard formation, or if the cutter elements 135 engaging the formation to a sufficiently large depth-of-cut (DOC), the TOB may increase sufficiently to overcome the torsional biasing force of torsion spring 482, resulting in rotation of connection member 450 relative to bit body 410. In general, once the torsional biasing force of torsion spring 482 is overcome, the greater the TOB, the greater the rotation of connection member 450 relative to bit body 410. The degree or amount of rotation of connection member 450 relative to bit body 410 for a given TOB can be controlled and varied, as desired, by adjusting the resiliency and torsional spring force generated by torsional spring 480. Thus, bit 400 can be designed to have a desired and predetermined relationship between TOB and rotation of connection member 450 relative to bit body 410.

As with bit 100 previously described, in this embodiment of bit 400, engagement of arms 172 and recesses 415, as well as engagement of rods 173 and bores 447, prevents torque control member 170 from rotating relative to bit body 410 about axis 405. Thus, as connection member 450 rotates relative to bit body 410, connection member 450 also rotates relative to torque control member 170. The rotation of connection member 450 relative to bit body 410 and torque control member 170 about bit axis 405 causes torque control member 170 to move axially relative to connection member 450 and bit body 410. In other words, relative rotation of connection member 450 relative to torque control member 170 actuates the axial movement of torque control member 170 relative to bit body 410. In particular, helical ramps 158, 175 are positioned and oriented such that rotation of connection member 450 in cutting direction 406 relative to bit body 410, such as would occur when the TOB increases, causes torque control member 170 to move axially downward (i.e., base 171 and arms 172 move axially away from end 450*b* and toward planar surface 412*a*); and rotation of connection member 450 in a direction opposite cutting direction 406 relative to bit body 410, such as would occur when the TOB decreases, causes torque control member 170 to move axially upward (i.e., base 171 and arms 172 move axially toward end 450*b* and away from planar surface 412*a*). Thus, the greater the TOB, the greater the axial extension of ends 173*b* from cutter-supporting surfaces 130 in cone region 141. Thus, by controlling the relationship between TOB and relative rotation of connection member 450 relative to bit body 410, the relationship between TOB and axial extension of ends 173*b* can be controlled.

In general, the greater the TOB, the greater the axial extension of ends 173*b* from cutter-supporting surfaces 130 in cone region 141. Depending on the TOB, ends 173*b* may (a) extend axially from cutter-supporting surfaces 130 but not into engagement with the formation, or (b) extend axially from cutter-supporting surfaces 130 into engagement with the formation. In the first case (a), ends 173*b* do not immediately change the DOC or TOB, but rather, limit the maximum DOC and TOB. In general, the greater the axial distance ends 173*b* extend from cutter-supporting surfaces 130 in cone region 141, the lower the maximum DOC of cutter elements 135 in cone region 141 and the lower the maximum TOB. In the second case (b), ends 173*b* limit the maximum DOC and TOB, and can also immediately decrease DOC and TOB if ends 173*b* extend sufficiently to effectively urge bit body 110 axially away from the formation. This offers the potential to enhance bit durability and operating lifetime. In particular, during drilling operations, a large spike or abrupt increase in TOB (e.g., resulting from transition from a soft to hard formation or an excessive DOC) may damage cutter elements. However, in embodiments described herein, extension of ends 173*b* limits the maximum DOC and hence TOB, and at sufficiently large TOBs, extension of ends 173*b* into engagement with the formation decreases the actual DOC and TOB.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A drill bit for drilling a borehole in an earthen formation, the bit having a central axis and a cutting direction of rotation, the bit comprising:

a connection member having a pin end;

a bit body coupled to the connection member, wherein the bit body is configured to rotate with the connection member about the central axis under a first torque-on-bit and wherein the bit body is configured to rotate relative to the connection member about the axis under a second torque-on-bit that is greater than the first toque-on-bit, wherein the bit body includes a bit face and a blade extending radially along the bit face;

a plurality of cutter elements mounted to a cutter-supporting surface of the blade; and a depth-of-cut limiting structure slidably disposed in a bore extending axially from the cutter-supporting surface;

wherein the depth-of-cut limiting structure is configured to move axially relative to the bit body in response to rotation of the bit body relative to the connection member.

2. The drill bit of claim 1, wherein the bore is disposed behind the cutter elements relative to a direction of rotation of the bit.

3. The drill bit of claim 1, wherein the depth-of-cut limiting structure is configured to extend axially from the cutter-supporting surface in response to an increase in torque-on-bit.

4. The drill bit of claim 1, wherein the bit face includes a cone region, a shoulder region, and a gage region;

wherein the blade extends radially from the cone region to the gage region;

wherein the bore intersects the cutter-supporting surface in the cone region.

5. The drill bit of claim 1, wherein the connection member includes a male insert portion disposed in a receptacle extending from an end of the bit body opposite the bit face.

6. The drill bit of claim 5, wherein the bit body has an inner surface defining the receptacle, wherein the inner surface includes a plurality of circumferentially spaced splines extending radially inward from the first cylindrical surface;

wherein the male insert portion includes a plurality of circumferentially spaced splines;

wherein one spline of the male insert portion is positioned between each pair of circumferentially adjacent splines of the bit body.

7. The drill bit of claim 6, wherein each spline of the connection member is circumferentially spaced from the adjacent spline of the bit body that leads the spline of the connection member relative to the direction of bit rotation.

8. The drill bit of claim 7, wherein a resilient elastomeric material is disposed between each spline of the connection member and the circumferentially adjacent spline of the bit body that leads the spline of the connection member relative to the direction of bit rotation.

9. The drill bit of claim 6, further comprising a torque control member comprising a base disposed in the receptacle axially between the male insert portion and the bit body, an arm extending radially outward from the base, and the depth-of-cut limiting structure extending axially from the arm.

10. The drill bit of claim 5, further comprising a biasing member disposed about the male insert portion and an actuation sleeve disposed about the male insert portion;

wherein the biasing member is axially disposed between the actuation sleeve and an annular shoulder of the connection member;

wherein the actuation sleeve has an end comprising a plurality of circumferentially-spaced helical ramps;

wherein the bit body has an inner surface defining the receptacle, wherein the inner surface includes an annular shoulder comprising a plurality of circumferentially spaced helical ramps;

wherein the biasing member is configured to bias the helical ramps of the actuation sleeve into sliding engagement with the helical ramps in the bit body.

11. The drill bit of claim 5, further comprising a torsional biasing member disposed about the male insert portion;

wherein the torsional biasing member has a first end coupled to the connection member and a second end coupled to the bit body;

wherein the torsional biasing member is configured to resist the rotation of the bit body relative to the connection member.

12. A method for managing torque-on-bit while drilling a borehole in an earthen formation, the method comprising:

(a) engaging the formation with a fixed cutter bit, wherein the fixed cutter bit includes a connection member and a bit body coupled to the connection member;

(b) applying weight-on-bit;

(c) applying a first torque-on-bit to rotate the connection member and the bit body together about a central axis;

(d) increasing the torque-on-bit from the first torque-on-bit to a second torque-on-bit that is greater than the first torque-on-bit; and (e) rotating the bit body relative to the connection member about the central axis to extend a depth-of-cut control structure axially from the bit body in response to the increase in the torque-on-bit.

13. The method of claim 12, further comprising:

extending the depth-of-cut control structure to a first axial distance from a bit face of the fixed cutter bit during (e);

increasing the torque-on-bit from the second torque-on-bit to a third torque-on-bit that is greater than the second torque-on-bit after (d) and (e); and extending the depth-of-cut control structure to a second axial distance from the bit face that is greater than the first axial distance in response to increasing the torque-on-bit from the second torque-on-bit to the third torque-on-bit.

14. The method of claim 12, wherein (e) comprises extending the depth-of-cut control structure axially into engagement with the formation.

15. The method of claim 14, wherein (e) further comprises decreasing the torque-on-bit from the second torque-on-bit to a third torque-on-bit that is less than the second torque-on-bit in response to engagement of the depth-of-cut control structure and the formation.

16. The method of claim 15, further comprising (f) withdrawing the depth-of-cut control structure axially toward a bit face of the fixed cutter bit in response to the decrease in the torque-on-bit during (e).

17. The method of claim 12, wherein the depth-of-cut control structure is a rod moveably disposed in a bore in the bit body.

* * * * *